US009889649B2

(12) United States Patent
Baba et al.

(10) Patent No.: US 9,889,649 B2
(45) Date of Patent: Feb. 13, 2018

(54) PRINTING CONTROL DEVICE, PRINTING CONTROL METHOD, AND STORAGE MEDIUM

(71) Applicant: CANON KABUSHIKI KAISHA, Tokyo (JP)

(72) Inventors: Naoko Baba, Kawasaki (JP); Hajime Nagai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 242 days.

(21) Appl. No.: 13/724,915

(22) Filed: Dec. 21, 2012

(65) Prior Publication Data

US 2013/0194337 A1 Aug. 1, 2013

(30) Foreign Application Priority Data

Jan. 31, 2012 (JP) ..... 2012-018827

(51) Int. Cl.
*B41J 2/07* (2006.01)
*B41J 2/21* (2006.01)

(52) U.S. Cl.
CPC ..... *B41J 2/07* (2013.01); *B41J 2/2128* (2013.01)

(58) Field of Classification Search
USPC ..... 347/11, 15, 14, 19
See application file for complete search history.

(56) References Cited

U.S. PATENT DOCUMENTS 5,276,459 A * 1/1994 Danzuka et al. ..... 346/33 A
5,502,468 A * 3/1996 Knierim ..... 347/19
5,975,672 A * 11/1999 Wen ..... B41J 2/04 347/11
5,980,013 A * 11/1999 Takahashi ..... B41J 2/0453 347/11
5,997,123 A * 12/1999 Takekoshi et al. ..... 347/14
6,116,709 A * 9/2000 Hirabayashi et al. ..... 347/14
6,116,710 A * 9/2000 Tajika et al. ..... 347/14
6,290,315 B1 * 9/2001 Sayama ..... 347/10
6,345,876 B1 * 2/2002 Tanaka ..... B41J 2/2135 347/19
6,390,583 B1 * 5/2002 Kato et al. ..... 347/15
6,409,301 B1 * 6/2002 Takata ..... B41J 29/393 347/19

(Continued)

FOREIGN PATENT DOCUMENTS

JP 2004058529 A 2/2004
JP 2004167947 A 6/2004

*Primary Examiner* — Matthew Luu
*Assistant Examiner* — Lily Kemathe
(74) *Attorney, Agent, or Firm* — Fitzpatrick, Cella, Harper & Scinto

(57) ABSTRACT

A printing control device comprising: a receiving unit configured to receive an instruction to perform adjustment of the number of droplets to be ejected from ejection ports of an ejection head on a unit region of a printing medium, the ejection ports corresponding to an energy generation element, the energy generation element using electrical energy to generate energy for ejecting liquid; and a decision control unit configured to decide an amount of the electrical energy to be applied to the energy generation element corresponding to the ejection ports so that each of the ejection ports ejects the droplets; wherein the decision control unit decides whether to decide an amount of the energy in response to the receiving unit's receiving the instruction.

15 Claims, 18 Drawing Sheets

(56) References Cited

U.S. PATENT DOCUMENTS

| | | | | |
|---|---|---|---|---|
| 6,428,134 | B1 * | 8/2002 | Clark et al. | 347/10 |
| 6,474,768 | B1 * | 11/2002 | Yano et al. | 347/19 |
| 6,494,557 | B1 * | 12/2002 | Kato et al. | 347/19 |
| 6,505,909 | B1 * | 1/2003 | Kato et al. | 347/19 |
| 6,629,789 | B2 * | 10/2003 | Kawatoko | 400/74 |
| 7,281,780 | B2 | 10/2007 | Nagamura et al. | |
| 7,380,897 | B2 * | 6/2008 | Anderson et al. | 347/19 |
| 7,393,077 | B2 * | 7/2008 | Kusakari | 347/19 |
| 7,517,044 | B2 | 4/2009 | Suzuki et al. | |
| 7,673,957 | B2 * | 3/2010 | Anderson et al. | 347/19 |
| 7,887,151 | B2 * | 2/2011 | Yamada et al. | 347/14 |
| 7,980,652 | B2 | 7/2011 | Baba et al. | |
| 8,444,243 | B2 * | 5/2013 | Kakutani | 347/15 |
| 8,602,518 | B2 * | 12/2013 | Mizes et al. | 347/19 |
| 8,733,874 | B2 | 5/2014 | Baba | |
| 2002/0060709 | A1 * | 5/2002 | Arquilevich et al. | 347/19 |
| 2007/0139456 | A1 * | 6/2007 | Ebihara | 347/15 |
| 2013/0194327 | A1 | 8/2013 | Hara et al. | |

* cited by examiner (*E+10)

| | | | | | |
|---|---|---|---|---|---|
| THRESHOLD VALUE OF NUMBER OF DOTS | Y | TOTAL NUMBER OF DOTS | ~5 | 5~10 | 10~ |
| | | THRESHOLD VALUE | 2 | 5 | 10 |
| | PC | TOTAL NUMBER OF DOTS | ~5 | 5~10 | 10~ |
| | | THRESHOLD VALUE | 2 | 5 | 10 |
| | C | TOTAL NUMBER OF DOTS | ~5 | 5~10 | 10~ |
| | | THRESHOLD VALUE | 2 | 5 | 10 |
| | Pgy | TOTAL NUMBER OF DOTS | ~5 | 5~10 | 10~ |
| | | THRESHOLD VALUE | 2 | 5 | 10 |
| | Gy | TOTAL NUMBER OF DOTS | ~5 | 5~10 | 10~ |
| | | THRESHOLD VALUE | 2 | 5 | 10 |
| | K | TOTAL NUMBER OF DOTS | ~5 | 5~10 | 10~ |
| | | THRESHOLD VALUE | 2 | 5 | 10 |
| | PM | TOTAL NUMBER OF DOTS | ~5 | 5~10 | 10~ |
| | | THRESHOLD VALUE | 2 | 5 | 10 |
| | M | TOTAL NUMBER OF DOTS | ~5 | 5~10 | 10~ |
| | | THRESHOLD VALUE | 2 | 5 | 10 |
| | R | TOTAL NUMBER OF DOTS | ~5 | 5~10 | 10~ |
| | | THRESHOLD VALUE | 20 | 20 | 10 |
| | G | TOTAL NUMBER OF DOTS | ~5 | 5~10 | 10~ |
| | | THRESHOLD VALUE | 20 | 20 | 10 |
| | B | TOTAL NUMBER OF DOTS | ~5 | 5~10 | 10~ |
| | | THRESHOLD VALUE | 20 | 20 | 10 |

FIG.13

(*E+10)

| | | | | | |
|---|---|---|---|---|---|
| THRESHOLD VALUE OF NUMBER OF DOTS FOR COLOR CALIBRATION | Y | TOTAL NUMBER OF DOTS | ~5 | 5~10 | 10~ |
| | | THRESHOLD VALUE | 1 | 2 | 7 |
| | PC | TOTAL NUMBER OF DOTS | ~5 | 5~10 | 10~ |
| | | THRESHOLD VALUE | 1 | 2 | 7 |
| | C | TOTAL NUMBER OF DOTS | ~5 | 5~10 | 10~ |
| | | THRESHOLD VALUE | 1 | 2 | 7 |
| | Pgy | TOTAL NUMBER OF DOTS | ~5 | 5~10 | 10~ |
| | | THRESHOLD VALUE | 1 | 2 | 7 |
| | Gy | TOTAL NUMBER OF DOTS | ~5 | 5~10 | 10~ |
| | | THRESHOLD VALUE | 1 | 2 | 7 |
| | K | TOTAL NUMBER OF DOTS | ~5 | 5~10 | 10~ |
| | | THRESHOLD VALUE | 1 | 2 | 7 |
| | PM | TOTAL NUMBER OF DOTS | ~5 | 5~10 | 10~ |
| | | THRESHOLD VALUE | 1 | 2 | 7 |
| | M | TOTAL NUMBER OF DOTS | ~5 | 5~10 | 10~ |
| | | THRESHOLD VALUE | 1 | 2 | 7 |
| | R | TOTAL NUMBER OF DOTS | ~5 | 5~10 | 10~ |
| | | THRESHOLD VALUE | 20 | 20 | 10 |
| | G | TOTAL NUMBER OF DOTS | ~5 | 5~10 | 10~ |
| | | THRESHOLD VALUE | 20 | 20 | 10 |
| | B | TOTAL NUMBER OF DOTS | ~5 | 5~10 | 10~ |
| | | THRESHOLD VALUE | 20 | 20 | 10 |

FIG.15

(*E+10)

| | | | | | |
|---|---|---|---|---|---|
| THRESHOLD VALUE OF NUMBER OF DOTS FOR SIMULTANEOUS COLOR CALIBRATION | Y | TOTAL NUMBER OF DOTS | ~5 | 5~10 | 10~ |
| | | THRESHOLD VALUE | 0.8 | 1.6 | 5 |
| | PC | TOTAL NUMBER OF DOTS | ~5 | 5~10 | 10~ |
| | | THRESHOLD VALUE | 0.8 | 1.6 | 5 |
| | C | TOTAL NUMBER OF DOTS | ~5 | 5~10 | 10~ |
| | | THRESHOLD VALUE | 0.8 | 1.6 | 5 |
| | Pgy | TOTAL NUMBER OF DOTS | ~5 | 5~10 | 10~ |
| | | THRESHOLD VALUE | 0.8 | 1.6 | 5 |
| | Gy | TOTAL NUMBER OF DOTS | ~5 | 5~10 | 10~ |
| | | THRESHOLD VALUE | 0.8 | 1.6 | 5 |
| | K | TOTAL NUMBER OF DOTS | ~5 | 5~10 | 10~ |
| | | THRESHOLD VALUE | 0.8 | 1.6 | 5 |
| | PM | TOTAL NUMBER OF DOTS | ~5 | 5~10 | 10~ |
| | | THRESHOLD VALUE | 0.8 | 1.6 | 5 |
| | M | TOTAL NUMBER OF DOTS | ~5 | 5~10 | 10~ |
| | | THRESHOLD VALUE | 0.8 | 1.6 | 5 |
| | R | TOTAL NUMBER OF DOTS | ~5 | 5~10 | 10~ |
| | | THRESHOLD VALUE | 18 | 18 | 7 |
| | G | TOTAL NUMBER OF DOTS | ~5 | 5~10 | 10~ |
| | | THRESHOLD VALUE | 18 | 18 | 7 |
| | B | TOTAL NUMBER OF DOTS | ~5 | 5~10 | 10~ |
| | | THRESHOLD VALUE | 18 | 18 | 7 |

FIG.17

PRINTING CONTROL DEVICE, PRINTING CONTROL METHOD, AND STORAGE MEDIUM

BACKGROUND OF THE INVENTION

Field of the Invention

The present invention relates to a printing apparatus and a density correction method, specifically to a printing apparatus having functions of color shift correction and density unevenness correction, and a method thereof.

Description of the Related Art

An inkjet printing apparatus provided with print heads or nozzle arrays having ejection ports (hereinafter, referred to as nozzles) for the same color ink is conventionally known as one of output devices that prints an image on various printing media such as paper. In such a printing apparatus with print heads or nozzle arrays, due to difference in ejection characteristic among respective print heads or respective nozzle arrays, some printed images may not achieve a desired color tone. That is, a desired color tone cannot be obtained partly because of existence or occurrence of difference in ejection characteristic among respective print heads or respective nozzle arrays since difference in ejection characteristic changes a density value of a printed image.

Factors of such difference in ejection characteristic among respective print heads or respective nozzle arrays includes variations in heat generation amount of heaters that eject ink (or film thickness of heaters) and variations in diameter of nozzles that eject ink. A change in heat generation amount of a heater with age and a change in viscosity of ink due to difference in usage environment may cause difference in ink ejection amount, changing a printing characteristic of an image formed on a printing medium.

As a technology to deal with difference in color tone due to difference in ejection characteristic among respective nozzle arrays or print heads as described above, color shift correction processing is known.

For example, color shift correction processing is performed by changing a γ table that is used in γ correction processing as part of image processing for correcting an ejection characteristic of a print head. Specifically, patches are printed on a printing medium by print heads or nozzle arrays, and a table to be used in γ correction processing is reset to be suitable on the basis of the resulting printed patches.

A method of detecting a color shift in printed patches includes a method to use an input device such as a scanner to detect printed patches. For example, there is known a method of correcting color including: printing a patch for each color material of C, M, Y, K; reading each patch by a scanner, a colorimetric device, a densitometer and/or like that is mounted to a printing apparatus; detecting a deviation of a read value from an expectation value of each patch; and changing a value such as a γ value on the basis of the deviation (see Japanese Patent Laid-Open No. 2004-0.167947).

Meanwhile, there is known a method of adjusting a driving pulse width of a print head to be suitable by keeping constant a factor of a ratio of a real input voltage to a critical driving voltage at which a print head can barely eject ink due to deterioration of the print head (see Japanese Patent Laid-Open No. 2004-58529). In this method, a print head is driven while a pulse width is reduced by a predetermined unit, each ejected ink droplet is detected by a photoelectronic sensor, thereby deciding an optimal number of driving pulses. By changing to a driving pulse (hereinafter, referred to as an ejection energy) decided in this way, ink can be stably ejected, thereby lengthening a life of a print head.

SUMMARY OF THE INVENTION

If changing an ejection energy of a print head (hereinafter, also referred to as Pth control) described in Japanese Patent Laid-Open No. 2004-58529 is performed after color shift correction (color calibration) described in Japanese Patent Laid-Open No. 2004-167997, color may change due to change of an ejection amount, as a result, a correction accuracy of color calibration may not be kept.

A printing control device according to the present invention for solving the above problem comprising: a receiving unit configured to receive an instruction to perform adjustment of the number of droplets to be ejected from ejection ports of an ejection head on a unit region of a printing medium, the ejection ports corresponding to an energy generation element, the energy generation element using electrical energy to generate energy for ejecting liquid; and a decision control unit configured to decide an amount of the electrical energy to be applied to the energy generation element corresponding to the ejection ports so that each of the ejection ports ejects the droplets; wherein the decision control unit decides whether to decide an amount of the energy in response to the receiving unit's receiving the instruction.

In the printing control device according to the present invention, an ejection energy is decided before performing color calibration. This avoids changing an ejection energy immediately after color calibration, and therefore the inkjet printing apparatus according to the present invention can prevent a color change due to change of an ejection energy, performing an accurate color calibration.

Further features of the present invention will become apparent from the following description of exemplary embodiments (with reference to the attached drawings).

BRIEF DESCRIPTION OF THE DRAWINGS

FIG. 13 is a table showing a dot number threshold value according to a first embodiment;

FIG. 15 is a table showing a dot number threshold value for calibration according to a second embodiment;

FIG. 17 is a table showing a dot number threshold value for simultaneous calibration according to a third embodiment.

DESCRIPTION OF THE EMBODIMENTS

Hereinafter, embodiments of the present invention will be described in details with reference to drawings.

(First Embodiment)

Figure 1:
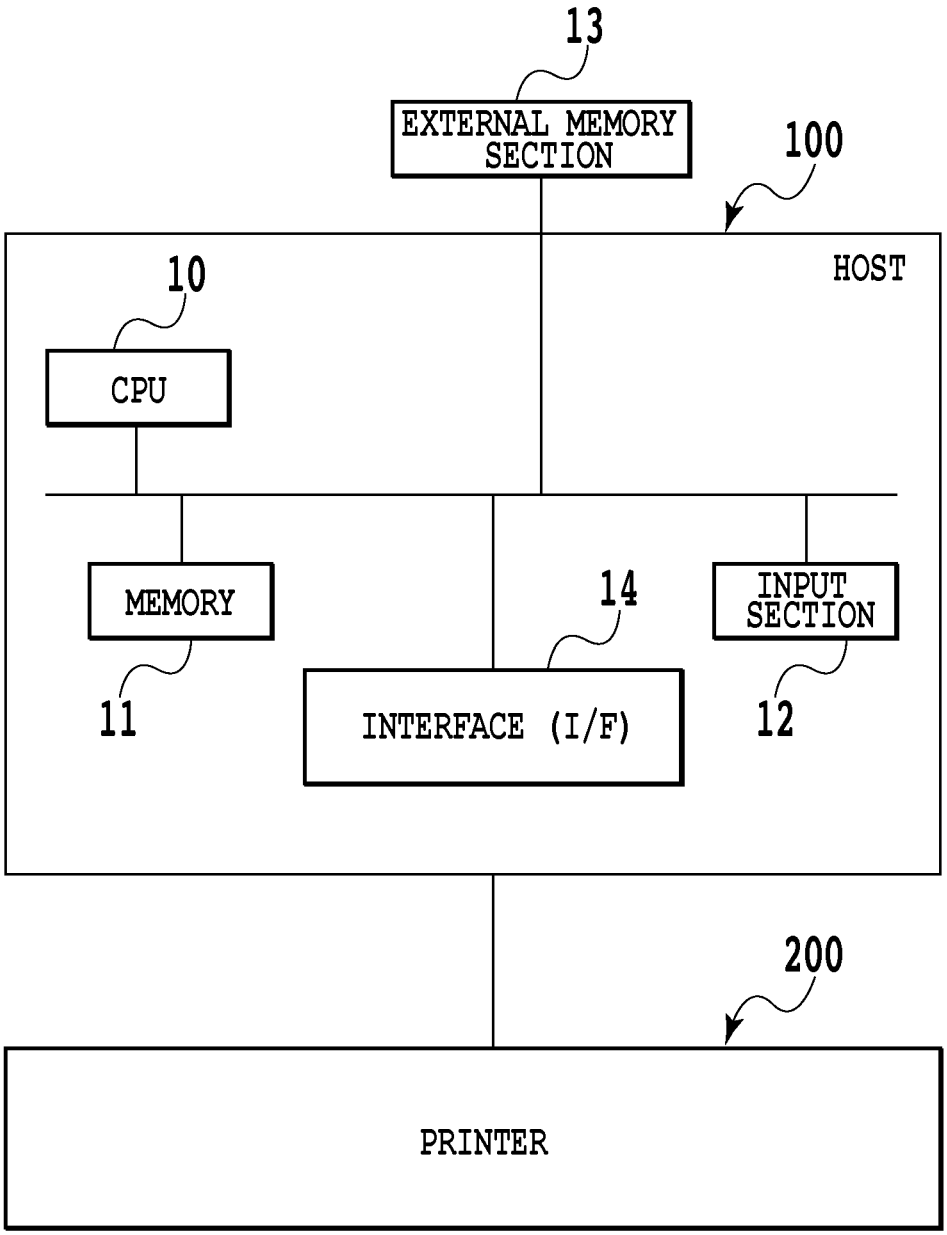
FIG. 1 is a block diagram illustrating a configuration of a printing system.

FIG. 1 is a block diagram illustrating a configuration of a printing system according to a first embodiment of the present invention.

In FIG. 1, a printing system includes a host device 100 as an information processor and a printer 200 as a printing apparatus.

The host device 100 is a personal computer, a digital camera or the like, and includes a CPU 10, a memory 11, an input section 12 such as a keyboard and mouse, and an interface 14 for communicating with the printer 200. The CPU 10 performs various processing according to a program stored in the memory 11. The program is supplied from an external memory section 13 such as a CD-ROM to be stored in the memory 11, or previously stored in the memory 11.

The host device 100 is connected to the printer 200 via the interface 14, and transmits to the printer 200 printing data expressed by R, G, B in image processing process that will be described later and image processing information such as a table for subsequent image processing.

The printer 200 performs image processing such as color processing that will be described later and binarization processing, and processing to correct a printing characteristic according to the present embodiment on the basis of the transmitted image processing information. The printer 200 can print printing data subjected to image processing.

<Configuration of Printer>

Figure 2:
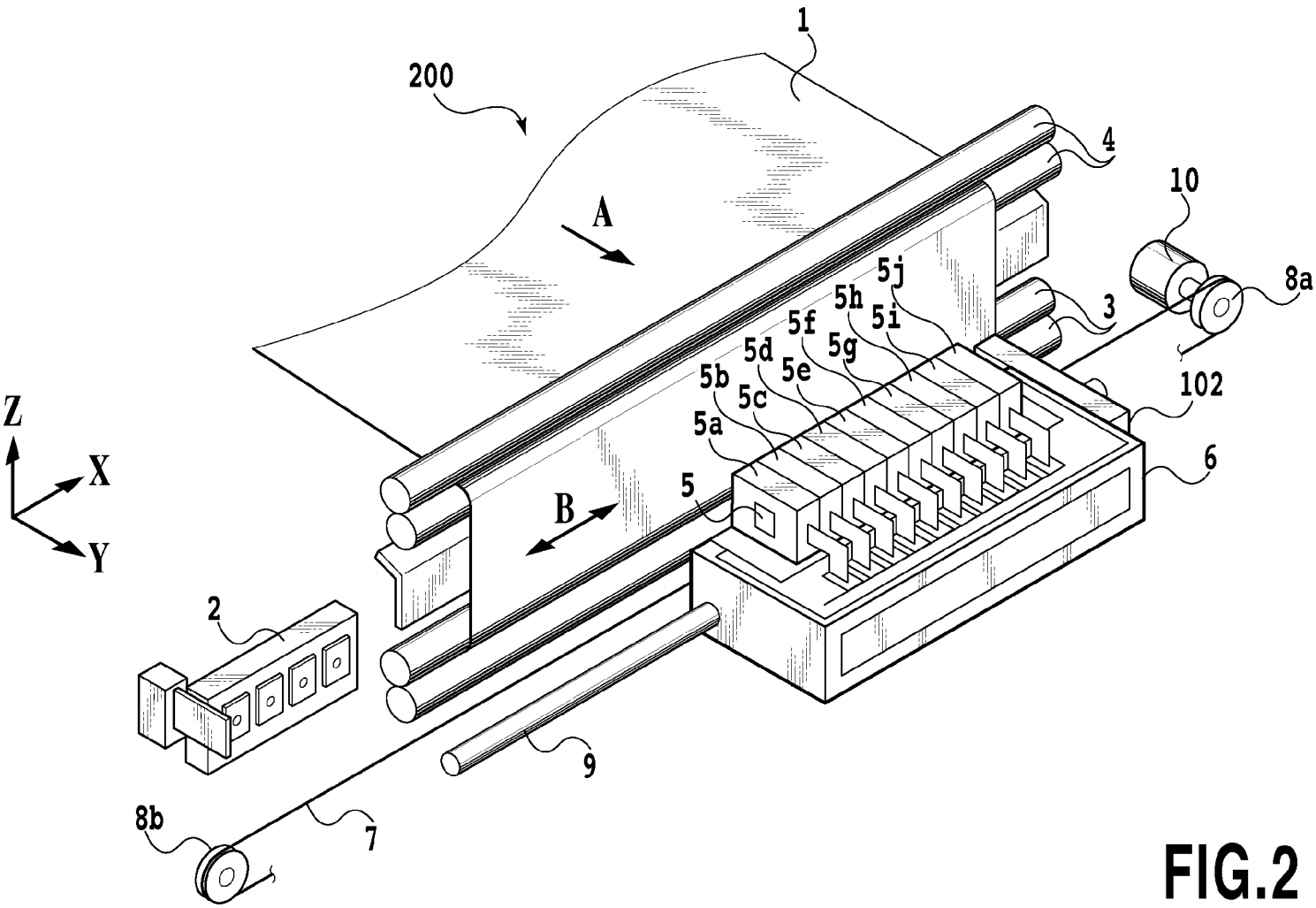
FIG. 2 is a schematic perspective view illustrating a mechanical configuration of a printer.

FIG. 2 is a schematic perspective view illustrating a mechanical configuration of the printer 200.

In FIG. 2, printing medium 1 such as printing paper and a plastic sheet is set so as to be laminated in an unillustrated cassette or the like, and in printing, the printing medium 1 are separated and fed sheet by sheet by an unillustrated paper feeding roller. The fed printing medium is conveyed by a predetermined amount in Arrow A direction (also referred to as conveying direction or sub-scanning direction) by a first conveying roller 3 and a second conveying roller 4 spaced from each other at a certain distance at a timing corresponding to scanning of a print head 5. The first conveying roller 3 is composed of a pair of rollers that are a driving roller driven by a stepping motor (not illustrated) and a driven roller that rotates according to rotation of the driving roller, and similarly the second conveying roller 4 is composed of a pair of rollers. The printer 200 can perform printing on a printing medium that is cut into a predetermined size and laminated in a cassette, as well as a roll-type printing medium.

The print head 5 is an inkjet print head that ejects ink of deep cyan (C), deep magenta (M), yellow (Y), black (K), pale cyan (PC), pale magenta (PM), gray (Gy), red (R), green (G), blue (B) colors to perform printing. The print head 5 according to the present embodiment is formed as a collection of individual print heads. Each of the individual print heads that compose the print head 5 as the collection has a nozzle array. Ink is supplied to the print head 5 from an unillustrated ink cartridge. Then, the print head 5 is driven in response to an ejection signal to eject each color ink from each of nozzles composing the nozzle array. Specifically, each of the nozzles ejecting ink is provided with an electricity-heat conversion element (also referred to as a heat generation section, a heater or an ejection energy generation element) therein. The print head 5 utilizes thermal energy generated by driving by the electricity-heat conversion element in response to an ejection signal, thereby generating air bubbles in ink by film boiling, and in turn ejecting ink by pressure of the air bubbles.

This print head 5 is mounted on a carriage 6. To the carriage 6 is transmitted a driving force of a carriage motor 10 via a belt 7 and pulleys 8*a*, 8*b*, which enables the carriage 6 to reciprocate along a guide shaft, thereby allowing scanning of the print head 5 in a main scanning direction.

To a side face of the carriage 6 is mounted a multi-purpose sensor 102. Where the multi-purpose sensor 102 is mounted on the carriage 6, a measurement section of the multi-purpose sensor 102 is disposed downstream a printing section of the print head 5 in a conveying direction. The multi-purpose sensor 102 is used for detecting a density of ink ejected to a printing medium, a width of the printing medium, a distance between the print head and the printing medium, and/or the like.

The above configuration enables the print head 5 to eject ink in response to an ejection signal while performing reciprocate-scanning in Arrow B direction, thereby performing printing by forming ink dots on the printing medium 1. The print head 5 moves to a home position according to need, and recovers from an ejection failure state due to a nozzle clogging and/or the like by recovery operation performed by an ejection recovery device 2 provided at the home position. After printing scanning (scanning while ejecting ink) by the print head 5, the conveying rollers 3, 4 is driven to convey the printing medium 1 by a predetermined amount in Arrow A direction. This printing scanning by the print head 5 and operation to convey the printing medium 1 are alternately performed to print an image and/or the like on the printing medium 1.

In the present embodiment, such a serial-scan-type printer is used. A print head in the present invention is not limited to be a serial scan type print head, but may be a full-line type print head.

Figure 3A:
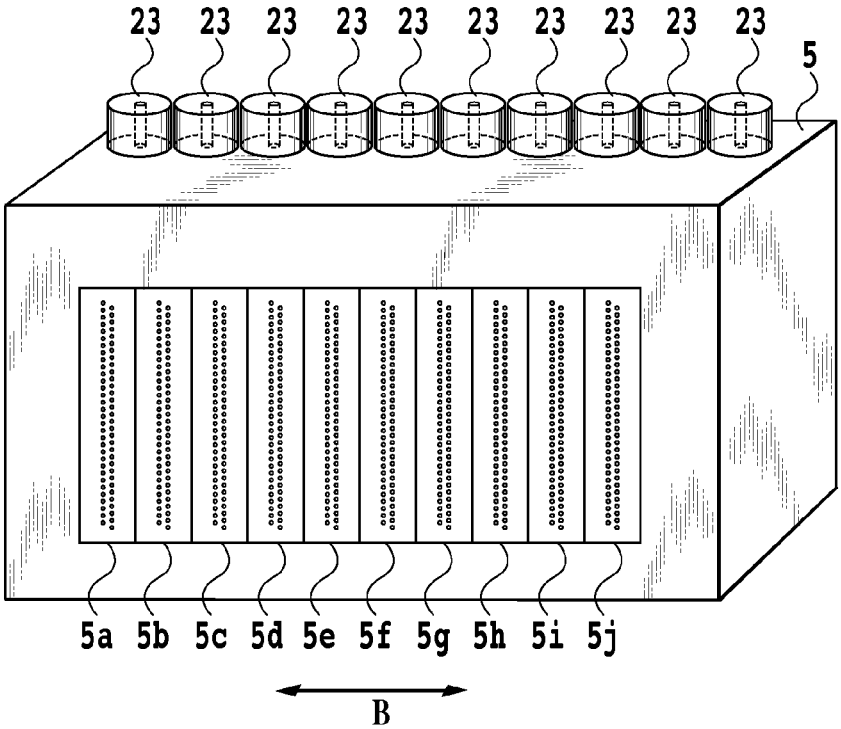
FIG. 3A is a schematic perspective view of a print head seen from a nozzle face side thereof from which ink is ejected.

FIG. 3A is a schematic perspective view of the print head 5 seen from a nozzle face side from which ink is ejected.

The print head 5 has ejection sections (hereinafter also referred to as nozzle arrays) 5*a* to 5*j* that can eject ink of different color tones (including color and density) arranged in main scanning direction B. To each of the ejection sections, ink is supplied from an ink introduction section 23 via an ink flow channel inside the print head 5. To the ink introduction section 23, ink is introduced from an ink tank via a supply tube.

To the nozzle arrays 5*a*, 5*b*, 5*c*, 5*d* are supplied deep cyan (C), deep magenta (M), yellow (Y) and black (K) inks, respectively. To the nozzle arrays 5e, 5*f*, 5*g*, 5*h*, 5*i* and 5*j* are supplied pale cyan (PC), pale magenta (PM), gray (Gy), red (R), green (G) and blue (B) inks, respectively. Hereinafter, the nozzle arrays 5*a*, 5*b*, 5*c* and 5*d* will be also referred to as C nozzle array, M nozzle array, Y nozzle array and K nozzle array, respectively; and the nozzle arrays 5*e*, 5*f*, 5*g*, 5*h*, 5*i* and 5*j* will be also referred to as PC nozzle array, PM nozzle array, Gy nozzle array, R nozzle array, G nozzle array and B nozzle array, respectively. Types and number of ink colors are not limited to these types and number.

Figure 3B:
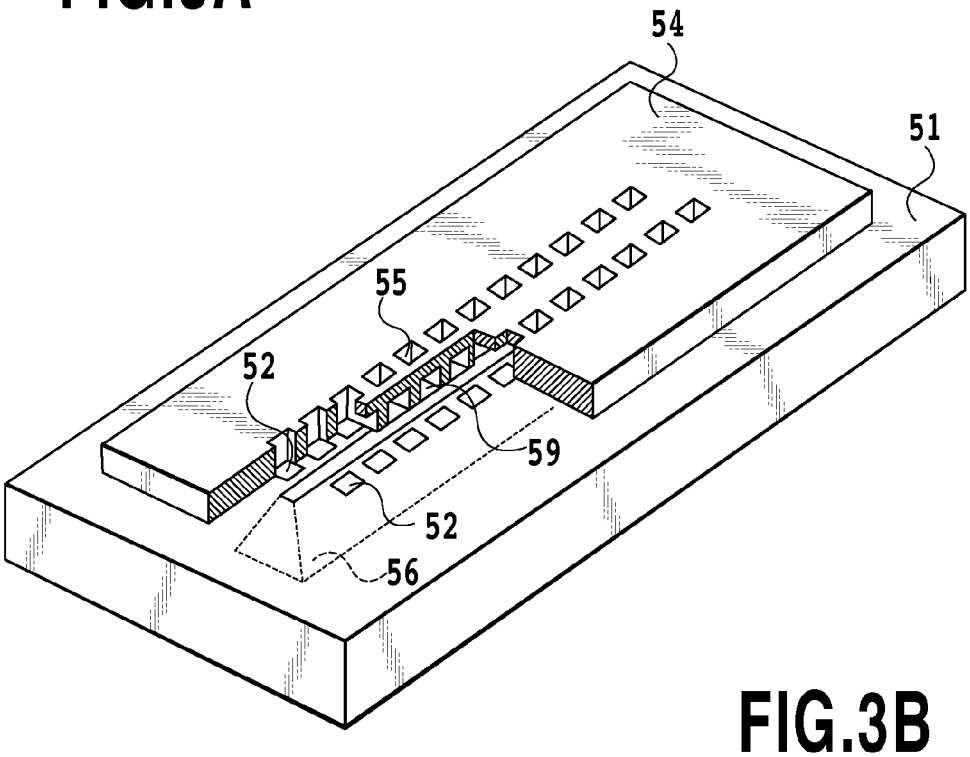
FIG. 3B is a schematic perspective view of each ejection section.

FIG. 3B is a schematic perspective view of one of the ejection sections. The ejection section uses, as energy to eject ink, a thermal energy that generates film boiling in ink in response to energization, and includes a substrate 51 having two heat generation section arrays arranged in parallel, the heat generation section arrays being composed of the heat generation sections (heaters) 52 disposed in a predetermined pitch. Between the two heat generation section arrays of the substrate 51 is disposed an ink supply port 56 in communication with the above ink flow channel. A nozzle 55 that corresponds to each of the heat generation section 52 and an ink channel 59 that corresponds to the nozzle 55 and supplies ink through the ink supply port 56 are formed in a member (orifice plate) 54, and the member 54 is attached to the substrate 51 to compose the ejection section. The heat generation sections 52 and nozzles 55 of one of the two heat generation section arrays are shifted by a half pitch from the heat generation sections 52 and nozzles 55 of the other, thereby realizing a desired printing resolution.

The respective ejection sections 5*a* to 5*j* of the print head 5 may have the same printing density and number of nozzles or different printing densities and number of nozzles. In the ejection portions 5*a* to 5*j* according to the present embodiment, 1280 nozzles are arranged for each color in a density of about 470 nozzles per 1 cm. In the present example, an ejection section in which the heat generation sections 52 eject ink in a direction perpendicular to the substrate 51 is used, but an ejection section in which ink is ejected in a direction parallel to the substrate 51 may be used.

Figure 4A:
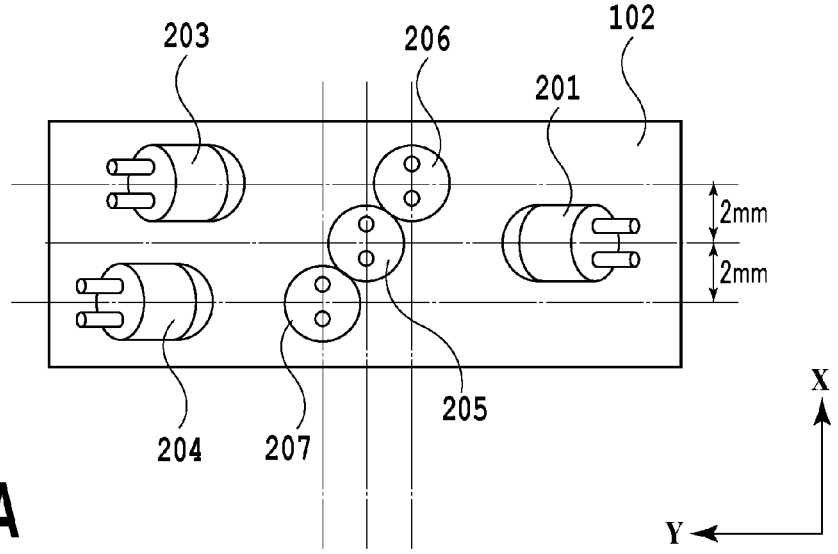
FIG. 4A is a schematic plain view of a multi-purpose sensor.
Figure 4B:
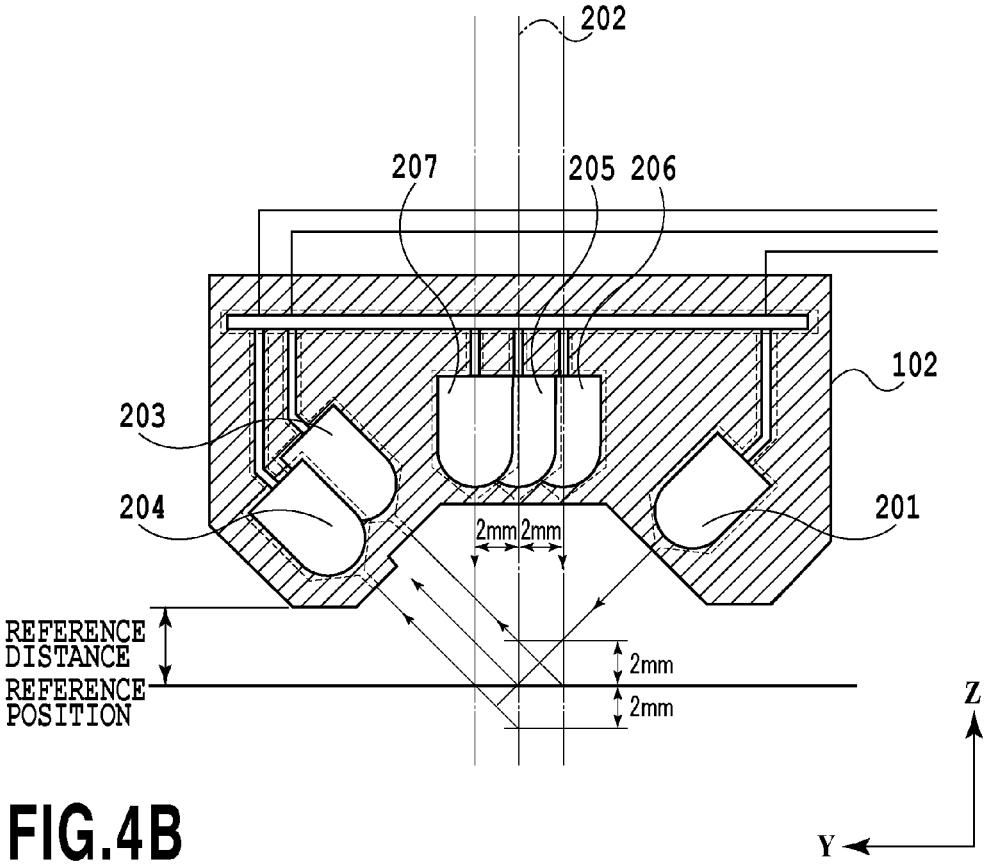
FIG. 4B is a schematic cross sectional view of the multi-purpose sensor.

Next, the multi-purpose sensor 102 mounted on the carriage 6 will be described with reference to FIGS. 4A and 4B. As described above, the multi-purpose sensor 102 is used for detecting a density (optical density) of ink ejected on a printing medium, a width of the printing medium, distance between the print head and the printing medium and/or the like. FIG. 4A is a schematic plain view of the multi-purpose sensor 102; and FIG. 4B is a schematic cross sectional view of the multi-purpose sensor 102.

The multi purpose sensor 102 includes one infrared LED, three visible LEDs and two photo transistors as optical elements. Each of the elements is driven by an unillustrated external circuit. All of these elements are bombshell-shaped with a diameter of about 4 mm in the maximum portion (a common production model in φ 3.0 to 3.1 mm size).

The optical elements will be described in detail. An infrared LED 201 is a light emitting element. The infrared LED 201 is disposed in such a way that an irradiation angle of its irradiation light is 45 degrees relative to a surface (a surface to be measured) of a printing medium in parallel with an XY plane and an optical axis of the irradiation light (an irradiation axis of the infrared LED) intersects a sensor central axis 202 in parallel with a normal line (Z axis) of the surface to be measured at a predetermined position. A position on Z axis of this intersecting position (intersection point) is set to be a "reference position", and a minimum distance between the multi-purpose sensor and the reference position in Z-axis direction is set to be a "reference distance". The irradiation light of the infrared LED 201 is optimized so as to form an irradiated surface (irradiated region) with a diameter of about 4 to 5 mm on the surface to be measured at the reference position by adjusting an irradiation width of the irradiation light by an aperture of the multi-purpose sensor through which irradiation light passes and is irradiated from the multi-purpose sensor.

In the present embodiment, a straight line that connects a center point of a region (range) of a surface to be measured that is irradiated by light from the light emitting element and a center of the light emitting element is called an optical axis of light emitting (an irradiation axis of the light emitting element). This irradiation axis is a center of flux of irradiation light. Irradiation light from the infrared LED is reflected by the surface to be measured. The optical axis that is also a center of flux of this reflected light is called a reflection axis of the infrared LED.

Of three visible LEDs 205, 206, 207 that are light emitting elements, the visible LED 205 is a monochromatic visible LED that has a green emission wavelength (about 510 to 530 nm). The visible LED 205 is disposed in such a way that its irradiation axis matches the sensor central axis 202.

The visible LED 206 is a monochromatic visible LED that has a blue emission wavelength (about 460 to 480 nm). With reference to FIG. 4A, the irradiation axis of the visible LED 206 is disposed in parallel with and apart by +2 mm in X direction and by −2 mm in Y direction from the irradiation axis of the visible LED 205 that is also the sensor central axis 202.

The visible LED 207 is a monochromatic visible LED that has a red emission wavelength (about 620 to 640 nm). With reference to FIG. 4A, the irradiation axis of the visible LED 207 is disposed in parallel with and apart by −2 mm in X direction and by +2 mm in Y direction from the irradiation axis of the visible LED 205 that is also the sensor central axis 202.

Two photo transistors 203, 204 are light receiving elements and are sensitive to light with a wavelength from visible light to infrared light. The photo transistor 203 is disposed in such a way that its light receiving axis is in parallel with the reflection axis of the infrared LED 201 and intersects with the irradiation axis of the visible LED 206 on the surface to be measured at the reference position. In this configuration, the light receiving axis of the photo transistor 203 is disposed apart from the reflection axis of the infrared LED by +2 mm in X direction, by −2 mm in Y direction, and +2 mm in Z direction.

Similarly, the photo transistor 204 is disposed in such a way that its light receiving axis is in parallel with the reflection axis of the infrared LED 201 and intersects with the irradiation axis of the visible LED 207 on the surface to be measured at the reference position. In this configuration, the light receiving axis of the photo transistor 209 is disposed apart from the reflection axis of the infrared LED by −2 mm in X direction, +2 mm in Y direction, and −2 mm Z direction.

Between the two photo transistors 203, 204 is a spacer with a thickness of about 1 mm, preventing light received by each of the two photo transistors 203, 204 from coming around. The multi-purpose sensor 102 has respective apertures for limiting light entrance on the photo transistor side thereof. A size of the aperture is optimized so as to receive reflected light corresponding to a region of diameter of 3 to 4 mm on the surface to be measured at the reference position.

In the above configuration, when the surface to be measured is at the reference position, the surface to be measured matches the intersection point of irradiation axes of the infrared LED 201 and visible LED 205, and the light receiving regions of the two photo transistors 203 and 204 are formed so as to sandwich the intersection point therebetween.

Figure 5:
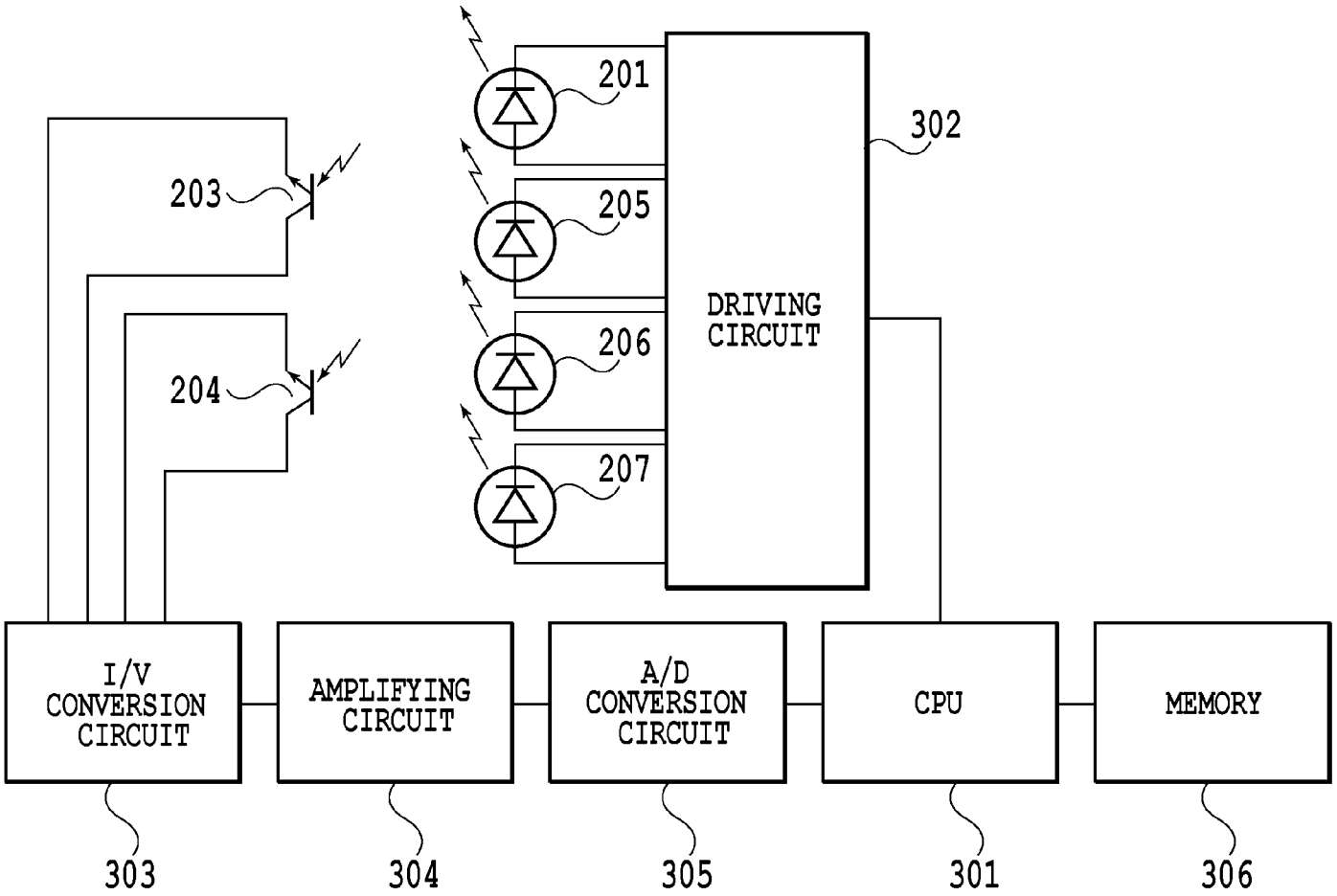
FIG. 5 is a schematic diagram of a control circuit to process input and output signals to and from the multi-purpose sensor.

FIG. 5 is a schematic diagram of a control circuit to process input and output signals of each element of the multi-purpose sensor 102 according to the present embodiment. A CPU 301 outputs an ON/OFF control signal of the infrared LED 201 and visible LEDs 205 to 207 that are light emitting elements, and performs an arithmetic operation of an output signal obtained according to light received by the photo transistors 203, 204 that are light receiving elements. A driving circuit 302 receives an ON signal sent from the CPU 301 thereby to supply a constant current to each of the light emitting elements, which in turn emits light, and to adjust an amount of light emission of each of the light emitting elements so that a received light amount of each of the light receiving elements is a predetermined amount. An I/V conversion circuit 303 converts an output signal sent as a current value from the photo transistors 203, 204 to a voltage value. An amplifying circuit 304 amplifies, the output signal after conversion to the voltage value that is a minute signal, to an optimal level in A/D conversion. An A/D conversion circuit 305 converts the output signal amplified by the amplifying circuit 304 to a 10 bit digital value and inputs the converted value to the CPU 301. A memory (such as a nonvolatile memory) 306 is used for storing a reference table for deriving a desired measured value from an operation result of the CPU 301 and temporarily storing an output value. As the CPU 301 and memory 306, a CPU and RAM in a printer may be used.

A mode of a sensor that can be used in the present invention is not limited to the above. As a multi-purpose sensor, a colorimetry device that can obtain spectral data may be used. Alternatively, a densitometer or a colorimetry device that is separate from the printer 200 or a densitometer or a colorimetry device that can be integrated to the printer may be used.

<Configuration Example of Control System>

Figure 6:
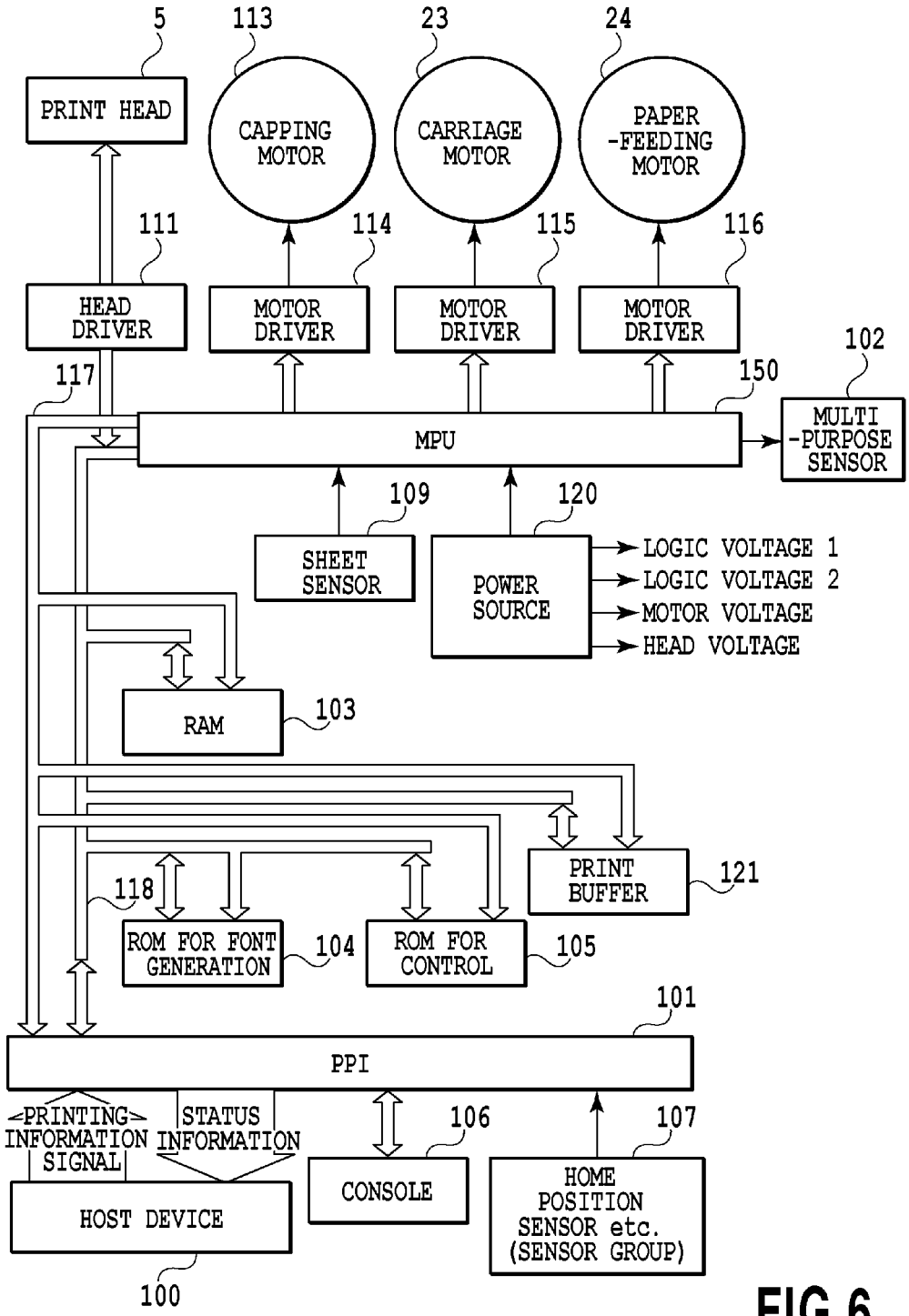
FIG. 6 is a diagram illustrating a configuration example of substantial parts of a control circuit of the printer.

FIG. 6 is a configuration example of a substantial part of a control circuit in a printer that can be applied to the present invention.

A programmable peripheral interface (PPI) 101 of the printer receives a command signal (a command) and a printing information signal containing printing data that are sent from the host device 100, and transfers these signals to a microprocessing unit (MPU) 150. The PPI 101 transmits status information of the printer 200 to the host device 100 according to need. The PPI 101 also performs an input to and receives an output from a console 106 that has a setting input section through which a user performs various settings on the printer and a display section that displays a message to a user. The PPI 101 further receives a signal inputted from a carriage unit, as well as a sensor group 107 that includes a home position sensor to detect that the print head 5 is at a home position and a capping sensor.

The MPU 150 controls each section of the printer according to processing procedures stored in a ROM for control 105 a control program corresponding to setting via an address bus 117 and a data bus 118. A RAM 103 stores a received signal, is used as a work area of the MPU 150, or temporarily stores various types of data. A ROM for font generation 104 stores pattern information such as characters and printing corresponding to code information, and outputs various types of pattern information corresponding to inputted code information. A print buffer 121 is for storing printing data developed in the RAM 103 and/or the like and has a capacity of printing M lines.

The ROM for control 105 can store not only the above control program but also various types of data including data necessary for detection of an ejection frequency and setting of a driving energy in the present invention. Such data include, for example, the number of passes for multi-pass printing, a carriage speed, setting of a height of a print head, an ink feed amount per unit area of a printing medium, and a printing direction. A type of a mask for thinning data applied to multi-pass printing, a driving condition (for example, a shape and time of a driving pulse to be applied to the heat generation section 52) of the print head 5, a size of an ink dot to be printed, and a condition of conveying a printing medium can also be stored.

Motor drivers 114 to 116 drive a capping motor 113, a carriage motor 23 and a paper feeding motor 24 in response to control of the MPU 150, respectively. A sheet sensor 109 detects the presence or absence of a printing medium, that is, whether a printing medium is fed to a position at which the print head 5 can perform printing. A head driver 111 drives the heat generation section 52 of the print head 5 in response to a printing information signal. A power source 120 supplies power to the above respective sections and has an AC adaptor and battery as a driving power supply unit.

In a printing system composed of the above printer and the host device 100 supplying a printing information signal to the printer, printing data can be transmitted from the host device 100 to the printer via a parallel port, infrared port, network or the like (see FIG. 1). In doing so, to printing data to be transmitted is added a required command. Such a command includes, for example, a type and size of a printing medium to be printed, a quality of printing, a route for feeding paper, and presence or absence of an automatic determination of an object. More specifically, with respect to a type of a printing medium to be printed, there are commands of a type such as a plain paper, OHP sheet and glossy paper, as well as a type of a special printing medium such as a transcription film, cardboard and banner paper. With respect to a size of a printing medium, there are commands such as A0 size, A1 size, A2 size, B0 size and B2 size. With respect to a quality of printing, there are commands such as quick, standard, fine, highlight of a specific color, and selection of monochrome or color. A paper feeding route is decided depending to a mode and type of a means to feed a printing medium in the printer, and there are, as commands thereof, for example, a roll paper and manual feeding. According to these commands, the printer reads out data necessary for printing from the above ROM 105 and performs printing on the basis of the data.

<Ink Ejection Energy Amount>

In the present invention, based on an r value that will be described later, a driving energy (ink ejection energy) amount for the print head to eject ink is represented by a K value that is defined as a square root of the r value in the following expression (1).

$$K=\sqrt{(r)} \tag{1}$$

Where a K value is a factor that indicates a ratio of a driving voltage actually applied to a critical driving voltage that is a driving voltage of approximately lower limit at which the print head can eject ink.

Let P denote a width of a pulse to be applied to the print head (if pulses are divided and applied, a total width of the passes), V denote a voltage to be applied, and P denote a heater resistance. Then, an input energy E can be represented by the following expression (2).

$$E=P\times V^2/R \quad (2)$$

Let Eth denote an input energy of approximately lower limit at which the print head can eject ink, and top denote an input energy in actual driving. An r value for finding a K value is represented by the following expression (3).

$$r=Eop/Eth \quad (3)$$

An r value can be practically found from a driving condition (a pulse width, voltage and the like) of the print head by either of the following two methods.

(Method 1)

Method 1 finds an r value with a pulse width fixed. Using a given pulse width, an appropriate voltage for the print head to eject ink is found, and the print head is driven at the voltage. Subsequently, a voltage to be applied is gradually reduced from the voltage to find a voltage at which ejection of ink stops. A voltage at which ink is ejected immediately before ejection of ink stops is set to be a voltage of approximately lower limit at which ink can be ejected, Vth. Let Vop denote a voltage actually used in driving, then an r value is represented by the following expression (4).

$$r=(Vop/Vth) \quad (4)$$

(Method 2)

Method 2 finds an r value with a voltage fixed. Using a given voltage, an appropriate pulse width for the print head to eject ink is found, and the print head is driven at the pulse width. Next, a pulse width to be applied is gradually shortened from the pulse width to find a pulse width at which ejection of ink stops. A pulse width at which ink is ejected immediately before ejection of ink stops indicates a pulse width of approximately lower limit at which ink can be ejected, Pth. Let Pop denote a pulse width actually used in driving, then an r value can be represented by the following expression (5).

$$r=Pop/Pth \quad (5)$$

From expressions (2) and (3), with the same r value, a square of V and P seem to be in inverse proportion to each other. However, actually, there are an electrical problem such as a problem that a pulse waveform may not become rectangular, a thermal problem such as a problem that thermal diffusion around a heater varies depending on variations of pulse waveforms, and a problem specific to an inkjet printer such as a problem that a thermal flux from the heater to ink varies depending on variations of voltage, changing a foaming state. Accordingly, a relationship between a square of V and P is not simple. Therefore, each of the above methods 1 and 2 must be independently dealt with, it should be noted that an error occurs if a value in one of the methods is converted to a value in the other of the methods by calculation, and it is desirable to perform correction by actual measurement.

<Ink Ejection Energy Setting Method (Pth Control Method)>

Figure 7:
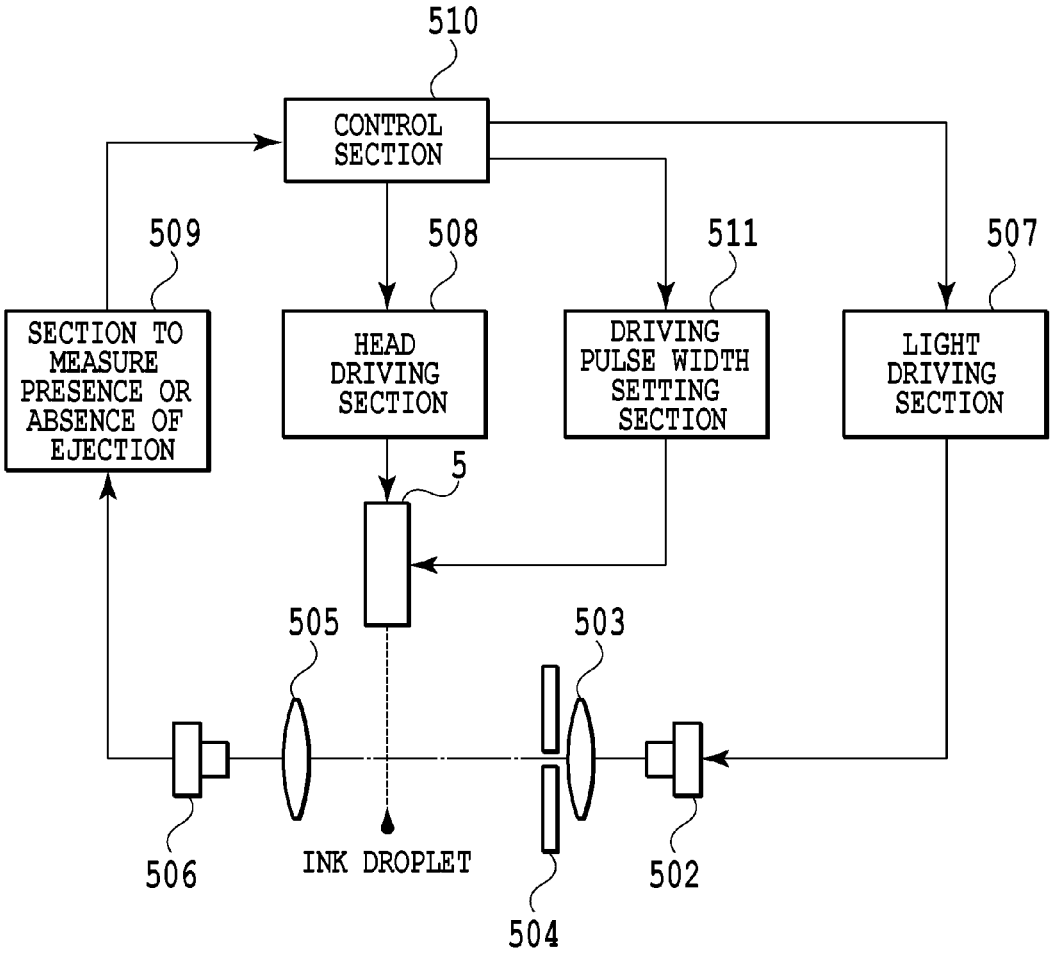
FIG. 7 is a block diagram illustrating a schematic electrical configuration of the printer according to an embodiment of the present invention.

FIG. 7 is a block diagram illustrating a schematic electrical configuration of the printer according to the present embodiment. Each driving section (driver) of the printer outputs a driving signal in response to a drive instruction from a control section 510 (corresponding to the MPU 150 in FIG. 6) to drive each section.

Driving the print head 5 by a head driving section 508 (corresponding to the head driver 111 in FIG. 6) will be specifically described. As described above, each nozzle of the print head 5 is provided with a heater (a heat generation section) that is an ejection energy generating element. By sending an electrical signal to the heater, the heater produces heat, thereby generating air bubbles in ink by film boiling. The generated air bubbles produce a pressure, which causes the print head to eject a predetermined amount of ink. In order to drive-control the print head 5 in this way, the control portion 510 sends a control instruction based on image data to the head driving section 508. The head driving section 508 receives the control instruction, and in turn sends an electrical signal to the heater of each nozzle of the print head 5, thereby drive-controlling ejection of ink from the print head 5.

In the present embodiment, whether ink is ejected from each nozzle of the print head 5 is detected as follows. In FIG. 7, a light 502 projects light that advances in a direction of crossing the space between the nozzle face of the print head 5 and the surface of a printing medium (not illustrated) (horizontal direction in FIG. 7). On or off of the light 502 is controlled on the basis of a signal from a light driving section 507 that has received a drive instruction from the control section 510. A light flux from the light 502 is collected into one point via a collecting lens 503 and passes through a slit 504 to become a planar light flux orthogonal to the traveling direction of an ink droplet ejected from the nozzle of the print head 5. This light flux passes through an imaging lens 505, which faces the collecting lens 503 across the print head, to reach a photoelectronic sensor 506. The slit 504 is disposed in parallel with the nozzle array of the print head 5 and has an elongated shape with a length greater or equal to a length of the nozzle array. Disposing the slit 504 can limit the light flux of the light 502 to a planar light flux extending across a direction of arrangement of the nozzle arrays of the print head 5 (main scanning direction). By employing such a configuration, when each nozzle ejects an ink droplet, the ejected ink droplet surely can block the light flux. When the ejected ink droplet blocks the light flux, the photoelectronic sensor 506 detects the blocking by, for example, a signal ratio of the time when an ink droplet blocks a light flux and the time when an ink droplet does not block a light flux. In this way, whether ink is ejected from the nozzle is measured. A result of this measurement is sent from the photoelectronic sensor 506 to a section to measure presence or absence of ejection 509.

Members such as the light 502, collecting lens 503, slit 504, imaging lens 505 and photoelectronic sensor 506 may be disposed outside a printing region. For example, if these members are disposed in a preliminary ejection region, an ink droplet that is ejected for detecting an ejection condition can be received in the preliminary ejection region, thereby performing detection processing without dropping ink on a printing medium.

The present embodiment further includes a driving pulse width setting section 511 that drives the print head while changing a pulse width of an electrical signal to be sent to a heater in order to measure a critical ejection driving pulse width that is a driving pulse width of approximately lower limit at which a nozzle can eject ink.

Figure 8:
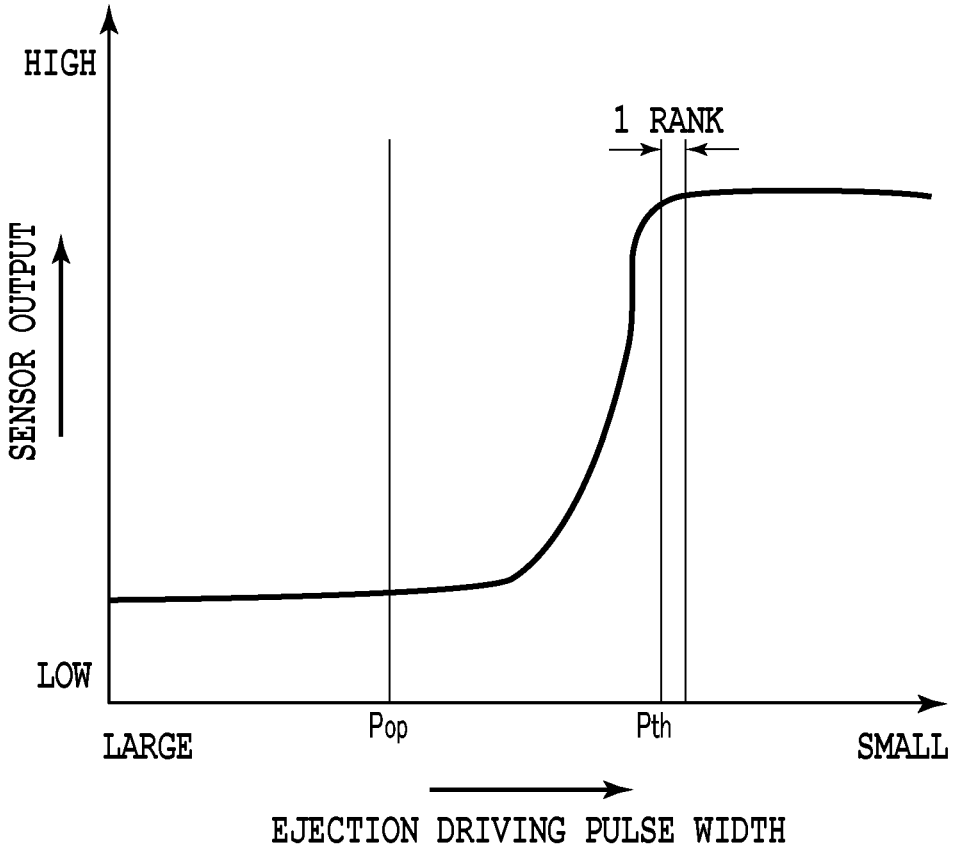
FIG. 8 is a graph illustrating a relationship between an ejection driving pulse width and a photoelectronic sensor output.

FIG. 8 is a graph illustrating a relationship between an ejection driving pulse width to be applied to the print head for ejecting ink and an output from the photoelectronic sensor.

Initially, the print head is in a state where all nozzles eject ink. Then, by gradually lowering a value of an ejection driving pulse width by a predetermined value, the number of nozzles that eject ink starts to reduce sharply at a certain pulse width, and finally all nozzles stop ejection. An output from the photoelectronic sensor that detects whether ink is ejected by change of an ejected amount of ink (the number of ejected ink droplets) also sharply changes at a certain point. An ejection driving pulse width that is greater by the above predetermined value than an ejection driving pulse width at which all nozzles stop ejection indicates a critical ejection driving pulse width, Pth, that is a pulse width of approximately lower limit at which a nozzle can eject ink. A driving pulse width, Pop, to be applied in actually driving the print head is set to be a width 1.4 times the critical ejection driving pulse width, Pth, considering a stable ejection and the like. In the present embodiment, the multiplication constant is 1.4 times, but the present invention can employ any multiplication constant as long as the multiplication constant can assure a stable ejection.

Figure 9:
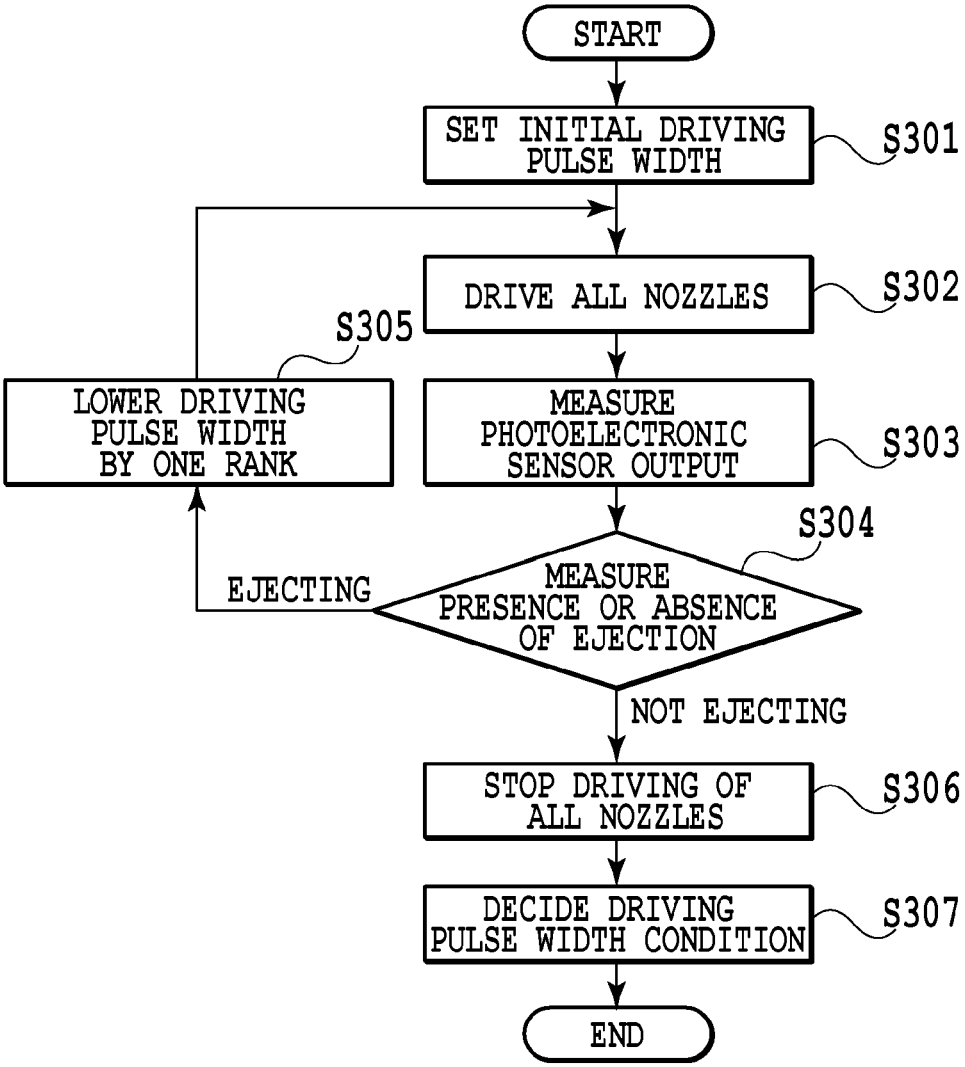
FIG. 9 is a flow chart illustrating processing for deciding a driving pulse width of a print head.

FIG. 9 is a flow chart illustrating processing routine for deciding a driving pulse width of the print head. The driving pulse width setting section 511 illustrated in FIG. 7 first sets a driving pulse width that is enough to drive all nozzles of the print head 5 as an initial driving pulse width (Step S301). Subsequently, the head driving section 508 drives all nozzles with the initial driving pulse width set at Step S301, thereby causing the nozzles to eject ink (Step S302). Simultaneously, the light driving section 507 turns the light on, and the photoelectronic sensor 506 measures an ejection condition of ink (Step S303). On the basis of this measurement by the sensor, the section to measure presence or absence of ejection 509 estimates the number of nozzles that are ejecting ink (Step S304). If at least one nozzle is ejecting ink, it is determined that ink is ejected. Meanwhile, if no nozzle is ejecting ink, it is determined that ink is not ejected. If it is determined that ink is ejected at Step S304, the driving pulse width setting section 511 reduces a driving pulse width by a predetermined pulse width value (hereinafter, referred to as one rank) (Step S305). Next, processing returns to Step S302 where all nozzles are driven again. Such processing will be repeated where a driving pulse width is reduced, all nozzles are driven at the reduced driving pulse width, an ejection condition of ink, that is, an output condition of the nozzles is measured. If it is determined that no nozzle is ejecting ink at Step S304, driving of all nozzles is terminated (Step S306).

A driving pulse width obtained by adding the above predetermined pulse width value (one rank) to the driving pulse width value at which no ejecting nozzle is detected is determined as a critical ejection driving pulse width, Pth. By setting the predetermined pulse width value expressed by the one rank to be smaller, a more precise critical ejection driving pulse width, Pth, can be obtained. The driving pulse width setting section 511 decides a pulse width 1.4 times this critical ejection driving pulse width, Pth, as a driving pulse width of the print head, Pop (Step S307). In actual printing operation, this driving pulse width Pop is applied to the heater to drive the print head.

Figure 10:
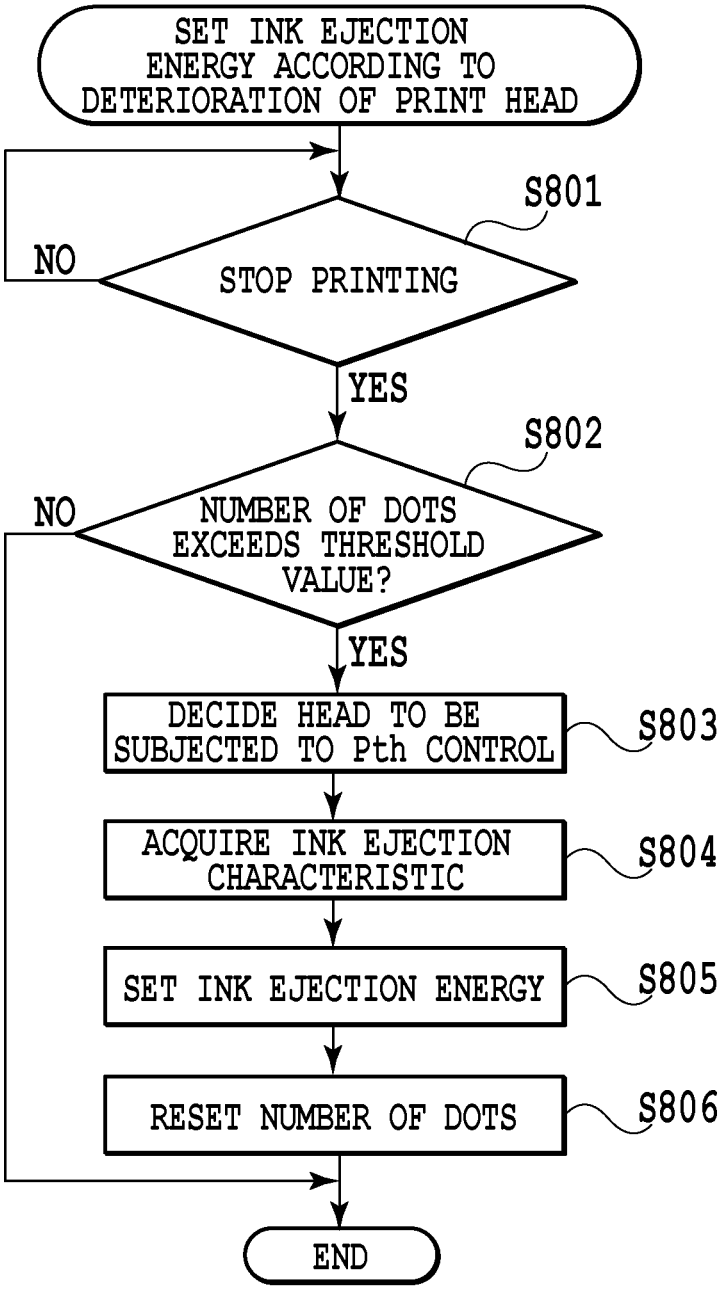
FIG. 10 is a flow chart illustrating a method of setting an ink ejection energy according to deterioration of a print head.

FIG. 10 illustrates a method to set an ink ejection energy according to deterioration of the print head.

First, when printing is completed (Step S801), it is determined whether the number of dots of ink (the number of ink droplets) ejected by the print head is greater than a predetermined threshold value (Step S802). A threshold value of the number of dots is previously stored, for each print head, in the RAM 103 of the printer 200 as a threshold value of the number of dots that corresponds to the total number of dots that each print head normally can eject, as illustrated in 13.

If the number of dots of ink ejected from a print head becomes greater than the threshold value (Step S802), the print head is decided as a print head to be subjected to control of the critical ejection driving pulse width, Pth (Step S803).

Subsequently, an ejection characteristic of the print head decided as the print head to be subjected to Pth control at Step S803 is acquired (Step S804), and an ink ejection energy is set according to the acquired ink ejection characteristic (Step S805).

After that, the measured number of dots is reset to be zero (Step S806).

The measurement of the number of dots is performed every time each print head for each color ink ejects ink.

<Image Processing Method>

Next, image processing method of generating printing data to be used in the printer 200 in the host device 100 and printer 200 will be described.

Figure 11:
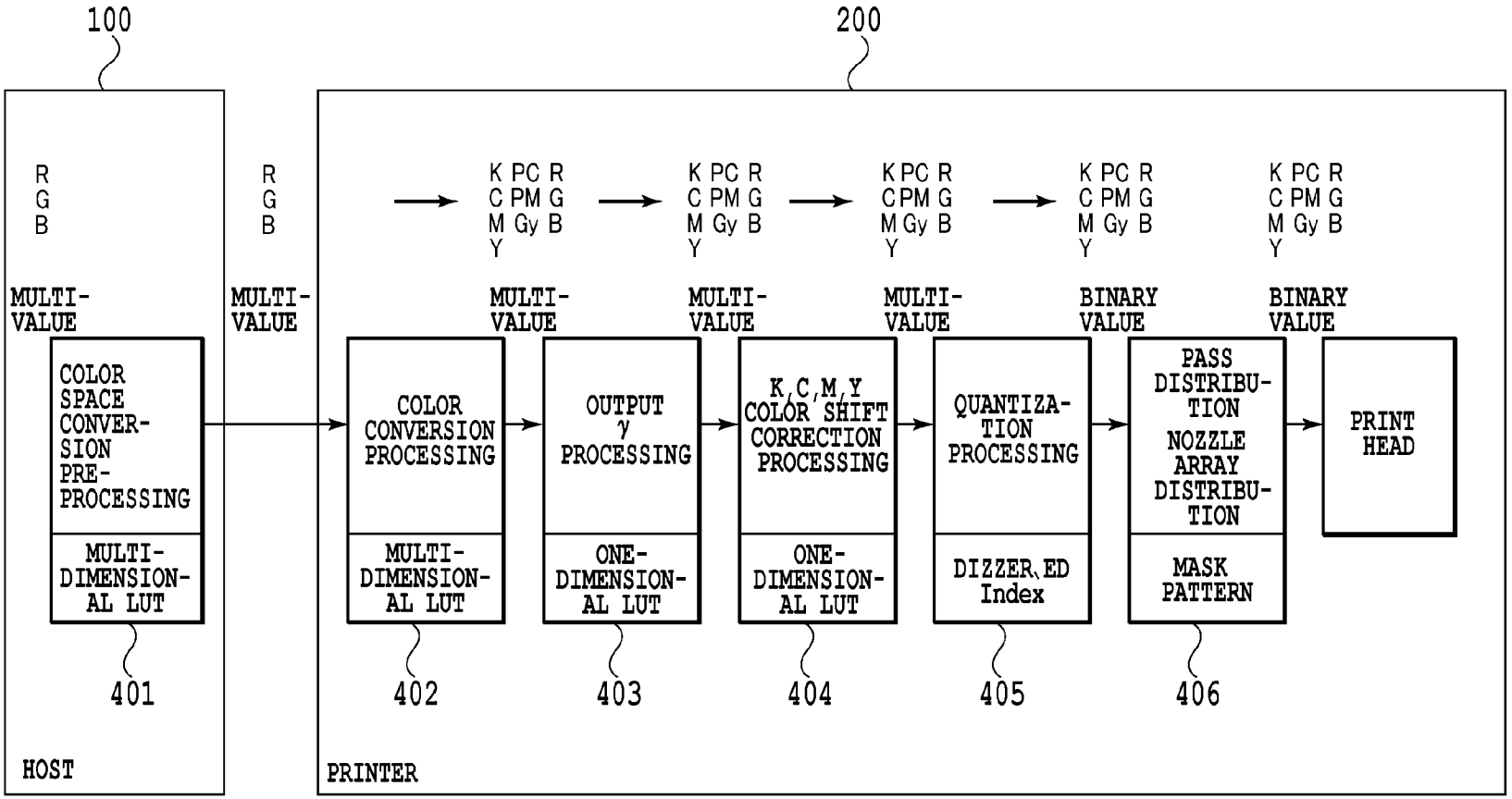
FIG. 11 is a block diagram illustrating configuration of image processing according to an embodiment of the present invention.

FIG. 11 is a block diagram illustrating a configuration of image processing according to the present embodiment. In Image processing according to the present embodiment, image data (luminance data) with eight bits for each color of red (R), green (G), blue (B) (256 gradations for each) is inputted. Processing will be performed for finally outputting as bit image data (printing data) of one bit for each nozzle array that is ejected by each of the C nozzle array, M nozzle array, Y nozzle array, K nozzle array, PC nozzle array, PM nozzle array, Gy nozzle array, R nozzle array, G nozzle array and B nozzle array. A type and gradation of color that can be applied in the present invention is not limited to these. First, color space conversion preprocessing (also referred to as former-stage color processing) will be described. In the host device 100, image data expressed by B, G, B multi-valued luminous signals is converted to R, G, B multi-valued data, using a multidimensional lookup table (LOT) 401. This color space conversion preprocessing is performed in order to correct difference between color space of an input image expressed by R, G, B image data of an object to be printed and color space that can be reproduced by the printer 200.

Next, color conversion processing (also referred to as latter-stage color processing) will be described. Data of each color of R, G, B subjected to the former-stage color processing is transmitted to the printer 200. The printer 200 receives the data of each color of R, G, B subjected to the former-stage color processing from the host device 100 and converts the received data to C, M, Y, K multi-valued data, using a multidimensional LUT 402. This color conversion processing is performed for color-converting RGB image data expressed by a luminous signal in an input system to CMYK image data expressed by a density signal in an output system. Such color conversion processing is performed since input data is often produced with three additive primary colors (RGB) of a light emitter such as a display whereas a printer and the like uses three subtractive primary colors (CMY) that expresses color by reflection of light.

Next, output γ processing will be described. C, M, Y, K, PC, PM, Gy, R, G, B multi-valued data subjected to the latter-stage color processing is subjected to output γ correction, using one-dimensional LOT 403 for each color. Normally, the number of dots printed per unit area of a printing medium and a printing characteristic such as a reflection density obtained by measuring a printed image do not have a linear relationship. Therefore, output γ correction processing to correct the multi-valued input gradation level of each color is performed so that an input gradation level of each 10 bits for each of C, M, Y, K, PC, PM, Gy, R, G, B and a density level of an image to be printed by the input gradation level have a linear relationship.

Next, color shift correction processing will be described. As an output γ correction table (one-dimensional LUT 403) used for output γ processing, an output γ correction table produced for a print head exhibiting a standard printing characteristic is often used. However, as described above, individual print heads are different in ink ejection characteristic. Therefore, an output γ correction table for correcting a printing characteristic of a printer with a print head exhibiting the standard ink ejection characteristic is not sufficient to obtain an appropriate output result for all printers. Accordingly, in the present embodiment, C, M, Y, K, PC, PM, Gy, R, G, B multi-valued data subjected to output γ correction is further subjected to color shift correction processing, using a one-dimensional LUT 404 for each color shift correction. The color shift correction processing is set according to density value information for each nozzle array that is obtained in a process to generate a color shift correction value, which will be described later.

Subsequently, C, M, Y, K, PC, PM, Gy, R, G, B multi-valued data subjected to color shift correction processing is subjected to quantization processing 405 by halftone processing such as a dither method and error diffusion (ED) method and Index development thereby to be converted to C, M, Y, K, PC, PM, Gy, R, G, B binary data.

After that, the binary data is subjected to pass distribution processing 406 with a mask pattern or the like, thus the data of each ink color is distributed into data to be printed by a nozzle array corresponding to each ink color.

<Printing Color Characteristic Acquisition Method>

Figure 12:
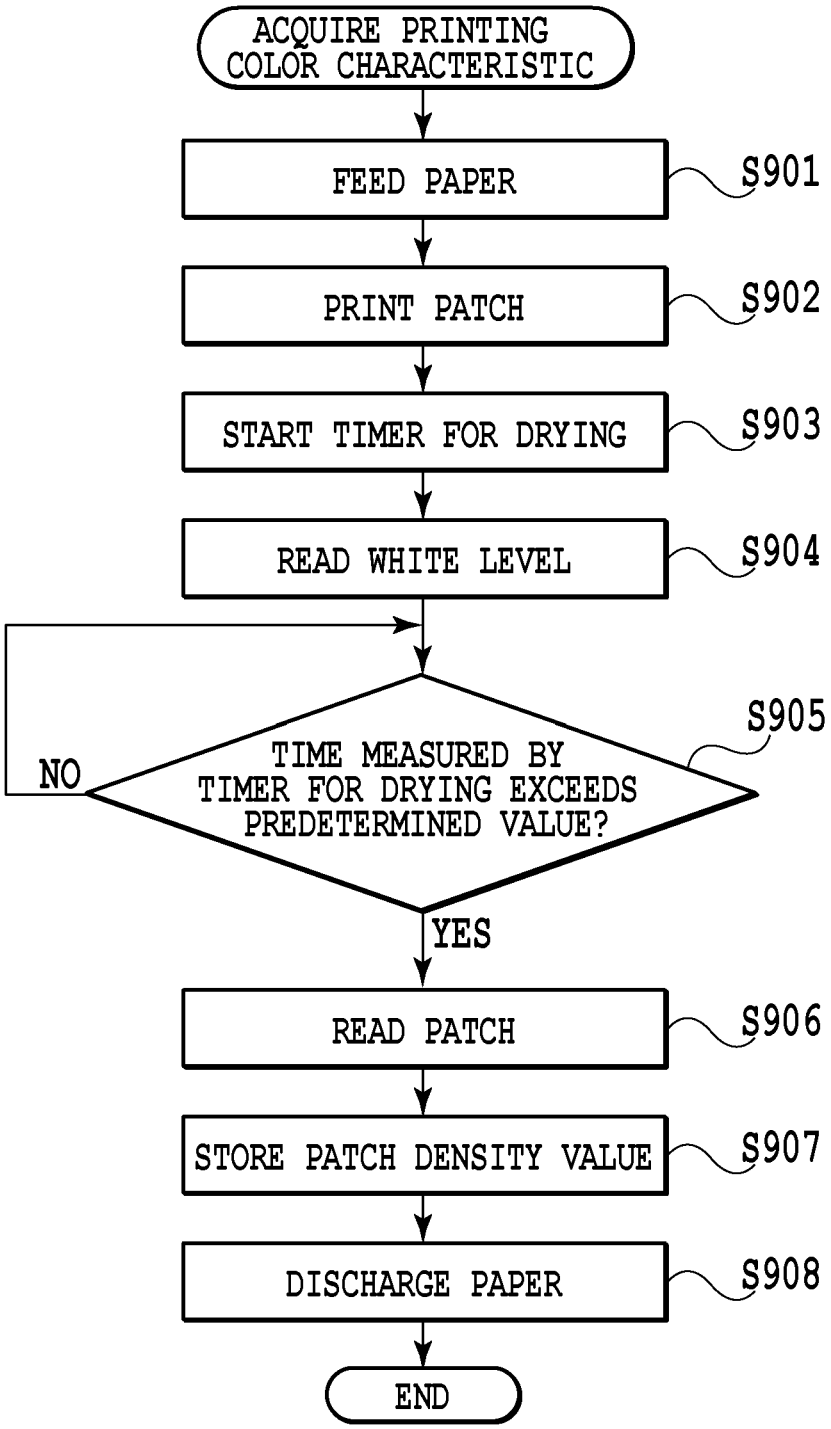
FIG. 12 is a flow chart for explaining a method of acquiring a printing color characteristic (color shift correction value) for the printer to print printing data.

Next, FIG. 12 illustrates a method of acquiring a printing color characteristic (color shift correction value) for the printer 200 to print data.

When an instruction to perform calibration operation that prints a patch and measure a density of the patch is inputted through an operation panel as a setting input section of the host device 100 or the console of the printer 200, a printing medium is first fed for printing a patch (Step S901). Then, the print head 5 as a means to print a patch prints patches (Step S902). The patches are printed for each ink color with different gradations. The instruction to perform calibration may be inputted by a user or may be inputted by CPU, MPU to PPI 101 in response to fulfilling a predetermined condition. The predetermined condition means that a printing medium is changed, that a temperature where the printer is placed has changed, or that a time longer than a predetermined time has passed after the last calibration.

Subsequently, timer measurement is started in order to stand by for a predetermined time for drying the patches printed at Step S902 (Step S903). Then, white level (that is, ground color of the printing medium) where patches are not printed is read (Step S904). In the reading, the multi-purpose sensor 102 is used to perform reflection luminosity measurement. A result of the measurement of while level is utilized as a reference of white when a density of the printed patch is later calculated. Therefore, a value of while level is kept for each LED. Here, with respect to a density of a blank space of a printing medium where patches are not printed, ground color of the printing medium is measured, and therefore ground color of a white printing medium is white.

In the present embodiment, an example in which a printing medium with white ground color will be described. Reflection luminosity measurement is performed in such a way that: of the visible LEDs 205 to 207 mounted on the multi-purpose sensor 102, the visible LED suitable for ink color whose density to be measured is turned on, and the photo transistors 203, 204 as a measurement means to measure a density of a patch reads reflected light.

After it is confirmed that time measured by the timer for drying reaches a predetermined time (Step S905), reading each patch is started (Step S906). In reading patches, the multi-purpose sensor 102 is used to perform reflection density measurement. The green LED 205 is turned on when, for example, patches printed with M ink, PM ink, B ink, and a blank space (white color) where patches are not printed are measured. The blue LED 206 is turned on when, for example, patches printed with Y ink, K ink, Gy ink and a blank space (white color) where patches are not printed are measured. The red LED 207 is turned on when, for example, patches printed with C ink, PC ink, G ink and a blank space (white color) where patches are not printed are measured.

When the patches at Step S906 is completed, a density value of each patch is calculated on the basis of output values from both of the patch and blank space (white color), and the density value of each patch is stored in a memory or RAM in the printer (Step S907). After that, the printing medium is discharged (Step S908) and processing is terminated.

Content of color shift correction processing is updated on the basis of the above measured density value. In the present embodiment, correction processing is performed for the one-dimensional LUT 404 to be used for color shift correction processing. Here, by comparing the measured density value of each patch obtained by density measurement with a predetermined targeted density value called a target value, a density correction value is calibrated so that a density of a patch to be printed approaches the target value. The target value may be obtained in such a way that a patch is previously printed by an accurate printer and print head and a density of the patch is measured. As just described, the target value is very close to an ideal value. Here, a table setting means such as the CPU 10 of the host device 100 or the CPU of the printer 200 generates a correction LUT (table setting process). The correction LUT is generated for each type of a printing medium and resolution, and the generated correction LOT is stored in a memory inside the printer. Alternatively, the correction LUT may be generated for each usage environment. In this way, the table is set on the basis of the patches printed by a patch printing means.

Alternatively, a table previously generated may be selected on the basis of the patches printed by a patch printing means. In this way, in performing calibration, if balance in ejection characteristic of respective ink colors of the print head is not desirable compared with balance of a print head exhibiting an appropriate ejection characteristic, a one-dimensional LUT table is selected so that the ejection characteristic approaches the appropriate ejection characteristic. For example, let us assume that an output value of an ejection characteristic of a print head ejecting deep cyan (C) color material is higher. At this time, from one-dimensional LUTs, each having a different correction value, for color shift correction, is selected and set the one-dimensional LUT table 404 in which an output value of C component is smaller than an input value of C component. By performing calibration in this way, even if a print head that applies a higher amount of C color material is used, correction is performed so as to make an output value for ejecting C color material smaller to reproduce the same color as that by a print head exhibiting a standard printing characteristic. This can keep an appropriate balance in ejection characteristic of respective colors of the print head.

In the present embodiment, the LUTs 402, 403 and 409 are stored in the printer 200, and may be previously stored in the ROM or RAM. If the LUTs 402, 903 and 404 are stored in the ROM, it is desirable that more than one LUTs are previously prepared for one objective, an appropriate LUT is selected and used from the LUTs.

Figure 14:
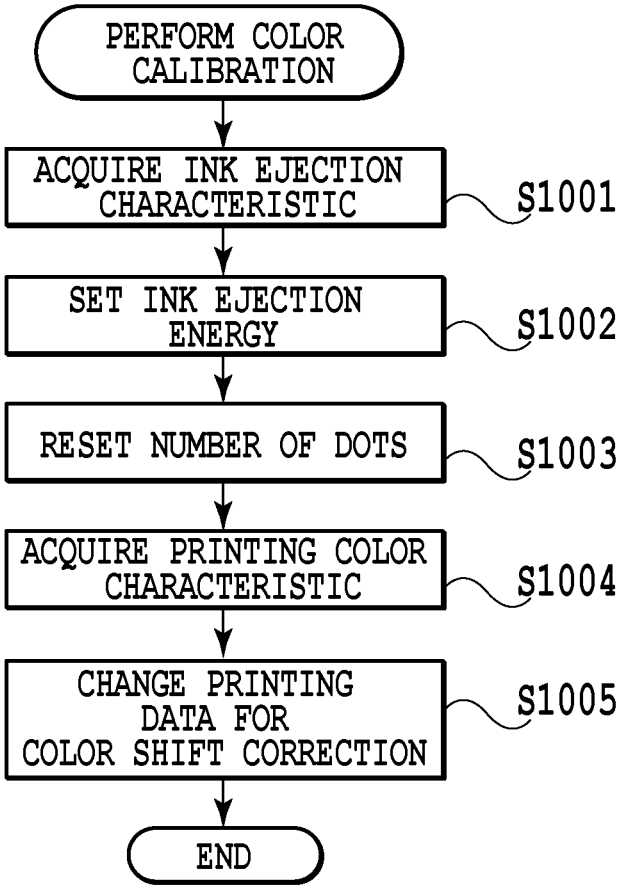
FIG. 14 is a processing flow of performing color calibration according to the first embodiment.

FIG. 14 illustrates a processing flow of color calibration (color shift correction) according to the present embodiment.

First, an ink ejection characteristic is acquired (Step S1001). Subsequently, an ink ejection energy is set by Pth control according to the ink ejection characteristic acquired at Step S1001 (Step S1002). Then, the measured number of dots is reset to be zero (Step S1003).

After that, a printing color characteristic is acquired where ejection is performed with the ink ejection energy set at Step S1002 (Step S1001). Then, printing data for color shift correction is changed according to the printing characteristic acquired at Step S1004 (Step S1005).

As described above, in the present embodiment, an ink ejection energy is set (that is, an ink ejection condition setting is performed) without exception before a printing color characteristic for color calibration is acquired. In the present embodiment, such color shift correction control avoid changing an ejection energy immediately after color calibration, thereby preventing a color change caused by change of an ejection energy and performing an accurate color calibration.

(Second Embodiment)

In the first embodiment, an ink ejection energy is set without exception before a printing color characteristic for color calibration is acquired. However, for setting an ink ejection energy, it takes time to acquire an ink ejection characteristic and consumes ink. Accordingly, in order to reduce the time and ink consumption, an ink ejection energy may be set at a necessary timing.

FIG. 15 shows a threshold value of the number of dots for calibration. A threshold value of the number of dots for calibration is stored for each print head in the RAM 103 of the printer 200 as the number of dots corresponding to the total number of dots, as shown in FIG. 15.

Figure 16:
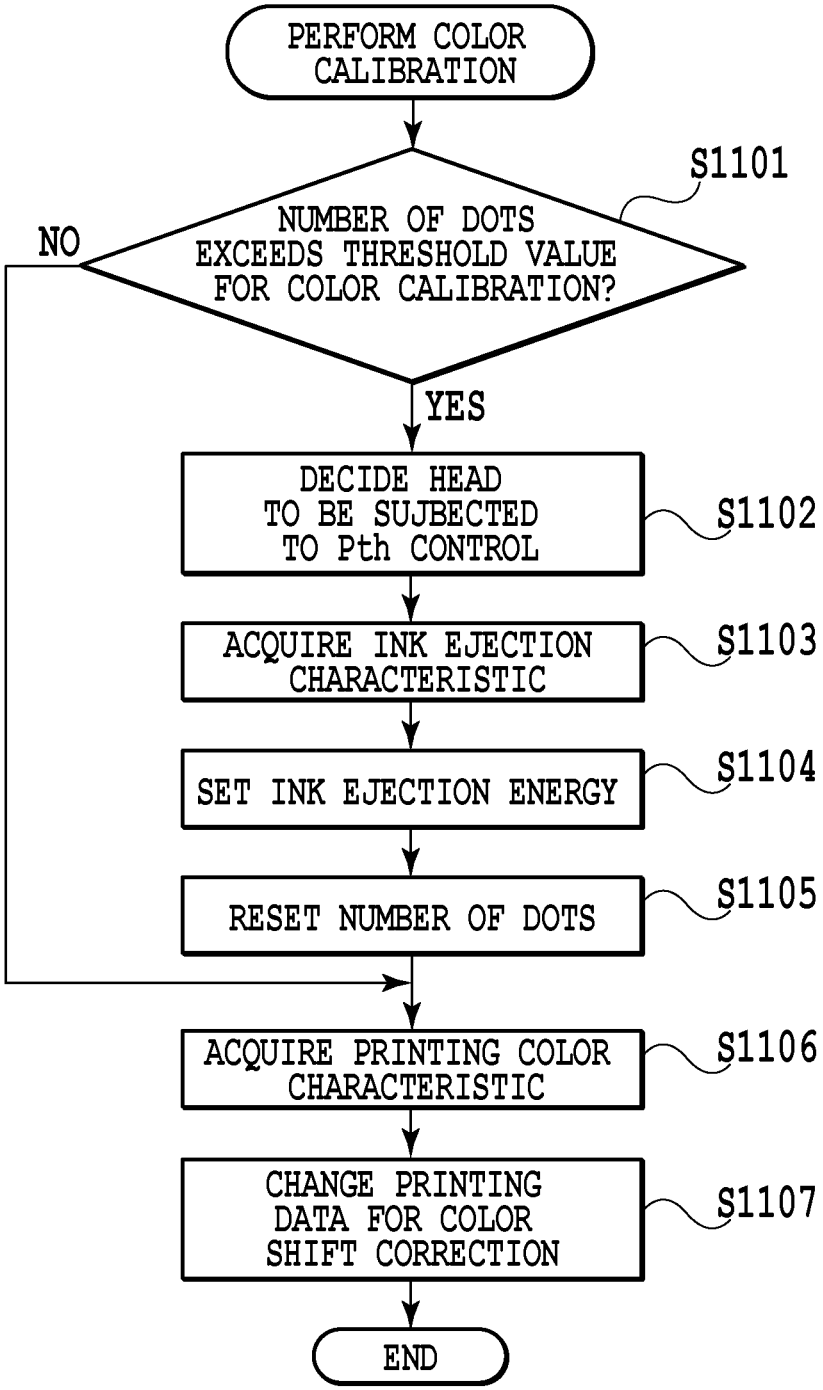
FIG. 16 is a processing flow of performing color calibration according to the second embodiment.

FIG. 16 illustrates a processing flow of color calibration according to the present embodiment.

First, it is determined whether the number of dots exceeds a threshold value for calibration in FIG. 15 (that is, timing to change an ink ejection energy is determined) (Step S1101). If the number of dots exceeds the threshold value, a print head whose number of dots exceeds the threshold value is decided to be subjected to ejection energy change (Pth control) (Step S1102).

Subsequently, an ink ejection characteristic of the print head decided at Step S1102 is acquired (Step S1103). An ink ejection energy is set by Pth control according to the acquired ink ejection characteristic (Step S1104). Then, the measured number of dots is reset to be zero (Step S1105).

After that, a printing color characteristic is acquired where ejection is performed with the ink ejection energy set at Step S1104 or with an already set ink ejection energy if not set at Step 1109 (Step S1106). Then, printing data for color shift correction is changed according to the printing color characteristic acquired at Step S1106 (Step S1107).

A threshold value of the number of dots for calibration is set to be the number of ejected ink dots with which color change caused by Pth control does not occur, and each print head may have a different threshold value depending on a tendency of color change.

As described above, in the present embodiment, an ink ejection energy is set at a necessary timing before a printing color characteristic for color, calibration is acquired. According to the present embodiment, this avoids changing an ejection energy immediately after color calibration, thereby preventing a color change caused by change of an ejection energy and performing an accurate color calibration.

(Third Embodiment)

In the second embodiment, Pth control is performed for only a print head whose number of dots exceeds a threshold value in color calibration, but simultaneously Pth control may be performed for a print head whose number of dots does not exceed a threshold value. That is because this can extends a period until an ejection energy is changed after color calibration.

Pth control may be simultaneously performed on all print heads, but since Pth control takes time, whether Pth control is simultaneously performed or not may be determined using a threshold value of the number of dots for simultaneous calibration.

A threshold value of the number of dots for simultaneous calibration is previously stored for each print head in the RAM 103 of the printer 200 as the number of dots corresponding to the total number of clots, as illustrated in FIG. 17. The threshold value of the number of dots for simultaneous calibration should be a value lower than a dot counter threshold value for calibration in FIG. 1S.

Figure 18:
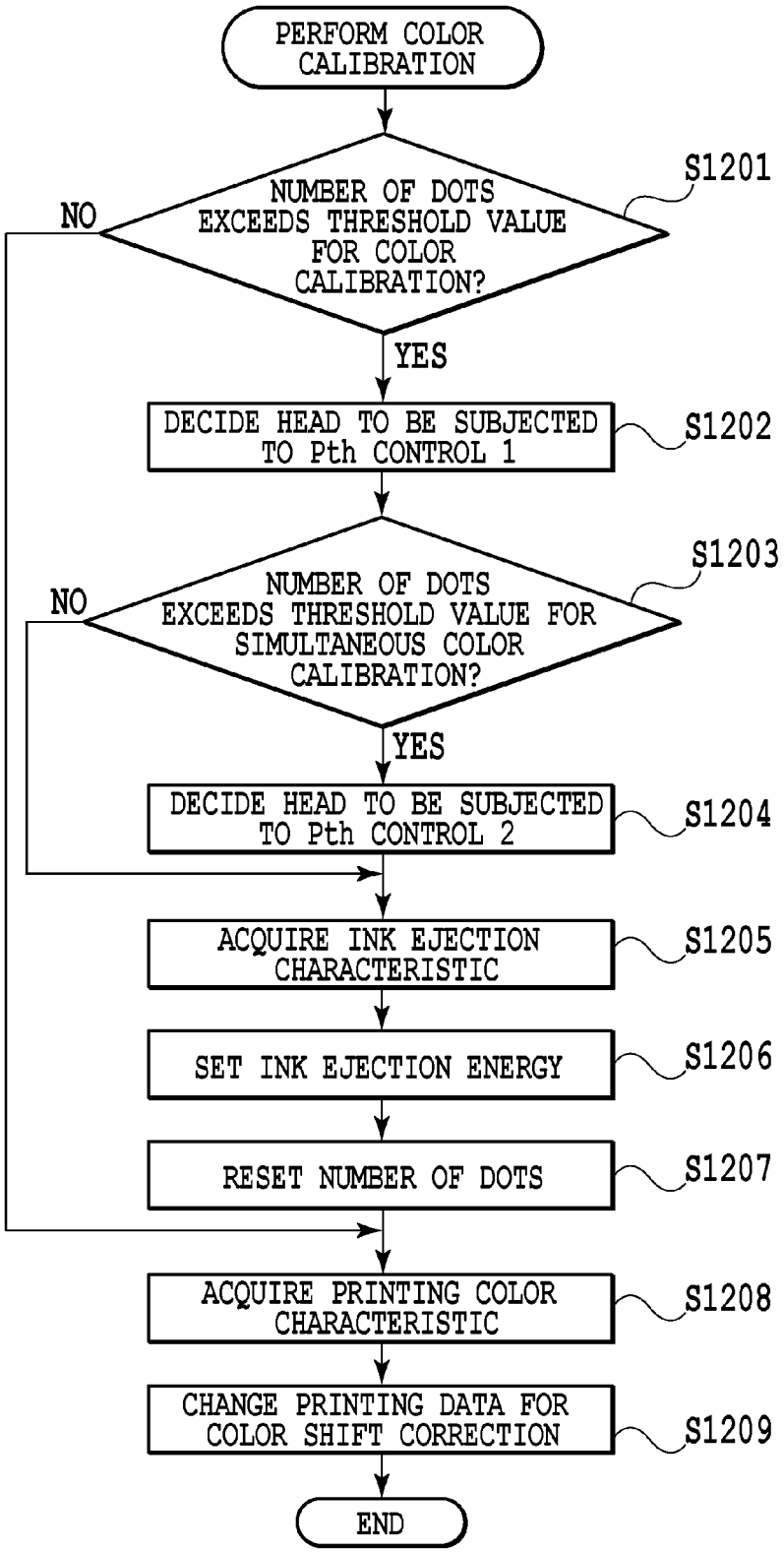
FIG. 18 is a processing flow of performing color calibration according to the third embodiment.

FIG. 18 illustrates a processing flow of color calibration according to the present embodiment.

First, it is determined whether the number of dots exceeds a threshold value for calibration shown in FIG. 15 (that is, a first timing determination for changing an ink ejection energy is performed) (Step S1201). If the number of dots exceeds the threshold value, a print head whose number of dots exceeds the threshold value is decided to be subjected to Pth control (Step S1202).

Subsequently, it is determined whether the number of dots exceeds a threshold value for simultaneous calibration shown in FIG. 17 (that is, a second timing determination to change an ink ejection energy is performed) (Step S1203). If the number of dots exceeds the threshold value, a print head whose number of dots exceeds the threshold value is decided to be subjected simultaneous Pth control (Step S1209).

Subsequently, ink ejection characteristics of the print heads decided at Step S1202 and Step S1204 are acquired (Step S1205). An ink ejection energy is set by Pth control according to the acquired ink ejection characteristics (Step S1206). Then, the measured number of dots is reset to be zero (Step S1207).

After that, a printing color characteristic is acquired where ejection is performed with an ink ejection energy set at Step S1206 or with an already set ink ejection energy if not set at Step 1104 (Step S1208). Then, printing data for color shift correction is changed according to the printing color characteristic acquired at Step S1208 (Step S1209).

As described above, in the present embodiment, an ink ejection energy is set for more print heads before a printing color characteristic for color calibration is acquired. This avoids changing an ejection energy immediately after color calibration, thereby preventing a color change caused change of an ejection energy and performing an accurate color calibration.

(Fourth Embodiment)

In the second and third embodiments, a method to count dots as information on the number of times of application of an electrical energy to an ink ejection energy generation section are described. However, as a fourth embodiment, in FIG. 15, a method may be employed in which an elapsed time after an ejection energy of a print head was changed last time is measured by a timer, the measured elapsed time is compared with a threshold time previously stored in the RAM 103 of the printer 200, and if the elapsed time exceeds the threshold time, the print head is decided to be subject to ejection energy change (Pth control) in the second embodiment (Step S1102).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-018827, filed Jan. 31, 2012, which is hereby incorporated by reference herein in its entirety.

What is claimed is:

1. A printing control device comprising:

a receiving unit configured to receive an instruction to perform a determination of a parameter used for correcting multi valued data indicating a gradation of an image formed by an ejection of ink from ejection ports of an ejection unit onto a unit region of a printing medium, the ejection ports corresponding to respective energy generation elements that use electrical energy to generate energy for ejecting liquid;

a parameter determining unit configured to determine the parameter in response to the receiving unit receiving the instruction, the parameter being determined according to a measurement result by a measurement unit configured to measure an optical density of a patch printed on the print medium by the ejection unit with the ink ejected by an amount of the electrical energy;

a decision operation control unit configured to control a decision operation that decides the amount of the electrical energy to be applied to the energy generation elements commonly for ejecting an ink droplet from the ejection ports, wherein in the decision operation, the decision operation control unit causes the ejection unit to eject ink using varied pulse waveforms, confirms that ink is ejected by certain pulse waveform and ink is not ejected by another pulse waveform corresponding to lower energy than the certain pulse waveform, and decides the amount of the electrical energy to be applied to the energy generation elements according to the confirmation, and an acquisition unit configured to acquire information on a number of times of application of the electrical energy to the energy generation elements, wherein in response to receiving the instruction by the receiving unit, the decision operation control unit decides whether to perform or not to perform the decision operation according to the acquired information, in a case where the acquired information indicates a number of times larger than a threshold number of times, the decision operation control unit performs the decision operation to decide the amount of the electrical energy and updates the amount of the electrical energy to be applied to the energy generation elements, the parameter determining unit causes the ejection unit to print the patch on the print medium using the updated amount of electrical energy, and in a case where the acquired information indicates the number of times not larger than the threshold number of times, the decision operation control unit does not perform the decision operation and the parameter determining unit causes the ejection unit to print the patch on the print medium using the amount of the electrical energy without updating the amount of the electrical energy.

2. A printing control device according to claim 1, wherein an amount of the electrical energy is decided by deciding a pulse width of an electrical signal to be applied to the energy generation element.

3. A printing control device according to claim 1, wherein an amount of the electrical energy is decided by deciding a voltage to be applied to the energy generation element.

4. A printing control device according to claim 1, wherein the decision operation decides an amount of the electrical energy on the basis of a detection by a sensor in the decision operation, and an ejection port ejects an ink droplet while the sensor detects that a predetermined amount of electrical energy is applied to the energy generation element and the sensor senses the ejected droplet.

5. A printing control device according to claim 1, further comprising an acquisition unit configured to acquire information on an elapsed time after an amount of the electrical energy was decided last time, wherein the decision control unit decides whether to decide an amount of the energy on the basis of the information on the time in response to the receiving unit's receiving the instruction.

6. A printing control device according to claim 1, wherein the decision operation control unit is configured to control the decision operation on the basis of a lower limit of electrical energy at which all of the energy generation elements can eject droplets from the ejection ports.

7. A printing control device according to claim 1, further comprising the ejection head configured to eject ink from ejection ports.

8. A printing control device according to claim 4, further comprising the ejection head configured to eject ink from ejection ports.

9. A printing control device according to claim 1, further comprising the measurement unit configured to measure the patch on the printing medium and the ejection head configured to eject ink from ejection ports.

10. A printing control device according to claim 1, wherein the receiving unit receives the instruction based on an input by a user.

11. A printing control device according to claim 1, further comprising an acquisition unit configured to acquire information on a number of times of application of the electrical energy to the energy generation elements, wherein the decision operation control unit determines whether to continue performing the decision operation on the basis of information on the number of times acquired by the acquisition unit.

12. A printing control device according to claim 11, wherein an amount of the electrical energy is decided on the basis of a detection by a detection unit in the decision operation, and an ejection port ejects an ink droplet when the detection operation control unit detects that a predetermined amount of electrical energy is applied to the energy generation element.

13. A printing control device according to claim 11, further comprising the ejection head configured to eject ink from ejection ports.

14. A printing control device according to claim 1, wherein the decision operation control unit decides whether to perform or not to perform the decision operation according to the acquired information and wherein the threshold number of times depends on a color of ink.

15. A printing control device according to claim 1, wherein the decision operation control unit decides whether to perform or not to perform the decision operation according to the acquired information, a first threshold number of times and a second threshold number of times lower than the first threshold number of times for the ejection units corresponding to different color respectively, and wherein a number of times indicated by the acquired information on the ejection unit corresponding to a first color is more than the first threshold number of times corresponding to the first color, a number of times indicated by the acquired information on the ejection unit corresponding to a second color is not more than the first threshold number of times corresponding to the second color, and a number of times indicated by the acquired information on the ejection unit corresponding to the second color is more than the second threshold number of times corresponding to the second color. the decision operation control unit decides to perform the decision operation for the ejection unit corresponding to the first color and the ejection unit corresponding to the second color.

* * * * *